US011559875B2

(12) United States Patent
Sullivan

(10) Patent No.: US 11,559,875 B2
(45) Date of Patent: Jan. 24, 2023

(54) SOCKET DRIVER, AND METHOD OF CONNECTING PERFORATING GUNS

(71) Applicant: XConnect, LLC, Denver, CO (US)

(72) Inventor: Shelby L. Sullivan, Minot, ND (US)

(73) Assignee: XConnect, LLC, Denver, CO (US)

( * ) Notice: Subject to any disclaimer, the term of this patent is extended or adjusted under 35 U.S.C. 154(b) by 106 days.

(21) Appl. No.: 17/332,279

(22) Filed: May 27, 2021

(65) Prior Publication Data

US 2021/0283751 A1 Sep. 16, 2021

Related U.S. Application Data

(63) Continuation-in-part of application No. 16/996,692, filed on Aug. 18, 2020, now Pat. No. 11,402,190, which is a continuation-in-part of application No. 16/894,512, filed on Jun. 5, 2020, now Pat. No. 11,255,650.

(60) Provisional application No. 63/048,212, filed on Jul. 6, 2020, provisional application No. 62/987,743, filed on Mar. 10, 2020, provisional application No. 62/890,242, filed on Aug. 22, 2019.

(51) Int. Cl.

| | |
|---|---|
| ***E21B 43/116*** | (2006.01) |
| ***B25B 13/50*** | (2006.01) |
| ***E21B 17/042*** | (2006.01) |
| *B25B 23/00* | (2006.01) |

(52) U.S. Cl.

CPC ..... *B25B 13/5033* (2013.01); *E21B 17/042* (2013.01); *E21B 43/116* (2013.01); *B25B 23/0035* (2013.01)

(58) Field of Classification Search

USPC ..... 89/1.15; 166/378

See application file for complete search history.

(56) References Cited

U.S. PATENT DOCUMENTS

| | | | |
|---|---|---|---|
| 2,418,486 | A | 4/1947 | Smylie |
| 3,173,992 | A | 3/1965 | Boop |
| 4,007,790 | A | 2/1977 | Henning |
| 4,007,796 | A | 2/1977 | Boop |
| 4,058,061 | A | 11/1977 | Mansur, Jr. et al. |
| 4,100,978 | A | 7/1978 | Boop |

(Continued)

FOREIGN PATENT DOCUMENTS

| | | | |
|---|---|---|---|
| CA | 2824838 | A1 | 2/2015 |
| GB | 2531450 | B | 2/2017 |

(Continued)

*Primary Examiner* — Reginald S Tillman, Jr.

(74) *Attorney, Agent, or Firm* — Peter L. Brewer; Thrive IP

(57) ABSTRACT

A socket driver for a perforating gun assembly. The socket driver includes a first end, and a second end opposite the first end. The second end defines an inner diameter that has a length to extend over a threaded end of the tandem sub. The socket driver is configured to mate with a shoulder along the tandem sub of the perforating gun assembly. Specifically, the socket driver includes a radial notched profile. The notched profile is configured to mate with a radial pattern of slots along the shoulder of the tandem sub. In one aspect, the socket driver is between 3 and 8 inches in length. In one aspect, the first end of the socket driver comprises an opening configured to receive a torque tool. A method of connecting ends of perforating guns using the socket driver is also provided herein.

25 Claims, 14 Drawing Sheets

(56) References Cited

U.S. PATENT DOCUMENTS

| | | | | |
|---|---|---|---|---|
| 4,140,188 | A | 2/1979 | Vann | |
| 4,182,216 | A | 1/1980 | DeCaro | |
| 4,266,613 | A | 5/1981 | Boop | |
| 4,411,491 | A | 10/1983 | Larkin et al. | |
| 4,523,650 | A | 6/1985 | Sehnert et al. | |
| 4,574,892 | A | 3/1986 | Grigar et al. | |
| 4,650,009 | A | 3/1987 | McClure et al. | |
| 4,660,910 | A | 4/1987 | Sharp et al. | |
| 4,747,201 | A | 5/1988 | Donovan et al. | |
| 4,850,438 | A | 7/1989 | Regalbuto | |
| 5,027,708 | A | 7/1991 | Gonzalez et al. | |
| 5,042,594 | A | 8/1991 | Gonzalez et al. | |
| 5,052,489 | A | 10/1991 | Carisella et al. | |
| 5,223,665 | A | 6/1993 | Burleson et al. | |
| 5,347,929 | A | 9/1994 | Lerche et al. | |
| 5,603,384 | A | 2/1997 | Bethel et al. | |
| 5,703,319 | A | 12/1997 | Fritz et al. | |
| 5,871,052 | A | 2/1999 | Benson et al. | |
| D417,252 | S | 11/1999 | Kay | |
| 6,006,833 | A | 12/1999 | Burleson et al. | |
| 6,263,283 | B1 | 7/2001 | Snider et al. | |
| 6,516,901 | B1 | 2/2003 | Falgout, Sr. | |
| 6,651,747 | B2 | 11/2003 | Chen et al. | |
| 7,013,977 | B2 | 3/2006 | Nordaas | |
| 7,193,527 | B2 | 3/2007 | Hall et al. | |
| 7,278,491 | B2 | 10/2007 | Scott | |
| 7,591,212 | B2 | 9/2009 | Myers, Jr. et al. | |
| 7,661,474 | B2 * | 2/2010 | Campbell | E21B 43/116 166/242.6 |
| 8,079,296 | B2 | 12/2011 | Barton et al. | |
| 8,439,114 | B2 | 5/2013 | Parrott et al. | |
| 8,869,887 | B2 | 10/2014 | Deere et al. | |
| 8,875,787 | B2 | 11/2014 | Tassaroli | |
| 9,145,764 | B2 | 9/2015 | Burton et al. | |
| 9,206,675 | B2 | 12/2015 | Hales et al. | |
| 9,284,819 | B2 | 3/2016 | Tolman et al. | |
| 9,441,465 | B2 | 9/2016 | Tassaroli | |
| 9,494,021 | B2 | 11/2016 | Parks et al. | |
| 9,574,416 | B2 | 2/2017 | Wright et al. | |
| 9,581,422 | B2 | 2/2017 | Preiss et al. | |
| 9,605,937 | B2 | 3/2017 | Eitschberger et al. | |
| 9,617,829 | B2 | 4/2017 | Dale et al. | |
| 9,702,680 | B2 | 7/2017 | Parks et al. | |
| 9,784,549 | B2 | 10/2017 | Eitschberger | |
| 9,822,618 | B2 | 11/2017 | Eitschberger | |
| 9,845,645 | B2 * | 12/2017 | Hughes | E21B 17/028 |
| 10,053,968 | B2 | 8/2018 | Tolman et al. | |
| 10,066,921 | B2 | 9/2018 | Eitschberger | |
| 10,077,641 | B2 | 9/2018 | Rogman et al. | |
| 10,138,713 | B2 | 11/2018 | Tolman et al. | |
| 9,903,192 | B2 | 12/2018 | Entchev et al. | |
| 10,151,152 | B2 | 12/2018 | Wight et al. | |
| 10,161,733 | B2 | 12/2018 | Eitschberger et al. | |
| 10,174,595 | B2 | 1/2019 | Knight et al. | |
| 10,352,144 | B2 | 7/2019 | Entchev et al. | |
| 10,352,674 | B2 | 7/2019 | Eitschberger | |
| 10,429,161 | B2 | 10/2019 | Parks et al. | |
| 10,458,213 | B1 | 10/2019 | Eitschberger et al. | |
| 10,472,938 | B2 | 11/2019 | Parks et al. | |
| 10,507,433 | B2 | 12/2019 | Eitschberger et al. | |
| 10,597,979 | B1 | 3/2020 | Eitschberger et al. | |
| 10,844,696 | B2 | 11/2020 | Eitschberger et al. | |
| 10,844,697 | B2 | 11/2020 | Preiss et al. | |
| D904,475 | S | 12/2020 | Preiss et al. | |
| 2005/0229805 | A1 | 10/2005 | Myers et al. | |
| 2008/0230218 | A1 * | 9/2008 | Hall | E21B 17/046 166/242.2 |
| 2010/0089643 | A1 | 4/2010 | Vidal | |
| 2015/0136419 | A1 | 5/2015 | Mauldin | |
| 2016/0084048 | A1 | 3/2016 | Harrigan et al. | |
| 2017/0314372 | A1 | 11/2017 | Tolman et al. | |
| 2018/0135398 | A1 | 5/2018 | Entchev et al. | |
| 2018/0202789 | A1 | 7/2018 | Parks et al. | |
| 2018/0202790 | A1 | 7/2018 | Parks et al. | |
| 2019/0049225 | A1 | 2/2019 | Eitschberger | |
| 2019/0257158 | A1 | 8/2019 | Langford et al. | |
| 2020/0032626 | A1 | 1/2020 | Parks et al. | |
| 2020/0199983 | A1 | 6/2020 | Preiss et al. | |
| 2020/0308938 | A1 | 10/2020 | Sullivan et al. | |
| 2020/0399995 | A1 | 12/2020 | Preiss et al. | |
| 2021/0172298 | A1 | 6/2021 | Knight et al. | |
| 2021/0189846 | A1 | 6/2021 | Bradley et al. | |
| 2021/0222526 | A1 | 7/2021 | Preiss et al. | |
| 2021/0223007 | A1 | 7/2021 | Kash et al. | |

FOREIGN PATENT DOCUMENTS

| | | | |
|---|---|---|---|
| GB | 2548203 | A | 9/2017 |
| WO | 2017147329 | A1 | 8/2017 |

* cited by examiner

SOCKET DRIVER, AND METHOD OF CONNECTING PERFORATING GUNS

CROSS REFERENCE TO RELATED APPLICATIONS

The present application is filed as a Continuation-in-Part of U.S. Ser. No. 16/996,692 filed Aug. 18, 2020. That application is entitled "Detonation System Having Sealed Explosive Initiation Assembly."

The '692 application was filed as a Continuation-In-Part of U.S. Ser. No. 16/894,512 filed Jun. 5, 2020. That application is also entitled "Detonation System Having Sealed Explosive Initiation Assembly."

These applications claimed the benefit of U.S. Ser. No. 63/048,212 filed Jul. 6, 2020. That application was also entitled "Detonation System Having Sealed Explosive Initiation Assembly."

These applications further claimed the benefit of U.S. Ser. No. 62/987,743 filed Mar. 10, 2020. That application was entitled "Detonation System Having Sealed Explosive Initiation Assembly."

These applications further claimed the benefit of U.S. Ser. No. 62/890,242 filed Aug. 22, 2019.

Each of these applications is incorporated herein in its entirety by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

TECHNICAL FIELD OF THE INVENTION

The present disclosure relates to the field of hydrocarbon recovery operations. More specifically, the invention relates to a socket driver that may be used to connect perforating gun barrels. Further, the invention relates to a method for connecting perforating guns in a tool string, wherein the perforating guns are connected at opposing ends of a tandem sub using the socket driver.

DISCUSSION OF THE BACKGROUND

For purposes of this disclosure, pending U.S. Ser. No. 16/996,692 will be referred to as "the parent application." The parent application is referred to and incorporated herein in its entirety by reference.

In the drilling of an oil and gas well, a near-vertical wellbore is formed through the earth using a drill bit urged downwardly at a lower end of a drill string. After drilling to a predetermined depth, the wellbore is reoriented using a steerable drilling assembly, causing the wellbore to deviate into a horizontal trajectory. A horizontal (or substantially horizontal) portion of the wellbore is then formed.

When the horizontal portion of the wellbore has reached a desired length, the drill string and bit are removed and the wellbore is lined with a string of casing. An annular area is thus formed between the string of casing and the formation penetrated by the wellbore. The annular area is then typically filled with cement.

The horizontal section of the wellbore will include a heel and a toe, with the toe defining the end (or "TD") of the wellbore. In order to enhance the recovery of hydrocarbons from the wellbore, particularly in low-permeability formations, the casing along the horizontal section undergoes a process of perforating and fracturing (or in some cases perforating and acidizing). Due to the very long lengths of new horizontal wells, the perforating and formation treatment process is typically carried out in stages.

In practice, a perforating gun assembly is pumped down towards the end of the horizontal leg at the end of a wireline. Such a perforating gun assembly is shown at 100 in FIG. 1. A lower portion of a wireline is seen above the perforating gun assembly 100, at 140.

The perforating gun assembly 100 will include a series of perforating guns 110, with each gun 110 having sets of charges 115 ready for detonation. The charges 115 associated with one of the perforating guns 110 are detonated and perforations (not shown) are "shot" into the casing, through the cement, and into the formation. Those of ordinary skill in the art will understand that a perforating gun 110 has explosive charges, typically shaped, hollow or projectile charges, which are ignited to create holes in the casing and to pass at least a few inches, and possibly several feet, into the formation. The perforations create fluid communication with the surrounding formation (or pay zone) so that hydrocarbon fluids can flow into the casing.

In order to provide perforations for multiple stages along a horizontal section without having to pull the perforating gun after every detonation, the perforating gun assembly 100 employs multiple guns 110 in series. Each perforating gun 110 represents various components. These typically include a "gun barrel" 112 which serves as an outer tubular housing. An uppermost gun barrel 112 is supported by the wireline (or "e-line") 140. The wireline 140 extends from the surface and delivers electrical energy down to the tool string 100. The wireline 140 also serves as a communication wire for sending signals from a control interface down to the perforating gun assembly 100.

Each perforating gun 110 also includes an explosive initiator, or "detonator." An illustrative detonator is shown at 594 in FIG. 25C of the parent application. The detonator is typically a small aluminum housing having a resistor inside. The detonator receives electrical energy from the surface and through the wireline 140, which heats the resistor. Additional details concerning operation of the detonator and an associated detonating cord are disclosed in the parent application and need not be repeated herein.

The perforating gun assembly 100 may include short centralizer subs 120. In addition, so-called tandem subs 125 are used to connect the gun barrel housings 112 end-to-end. Each tandem sub 125 comprises a metal threaded connector placed between the gun barrels 110. Typically, the gun barrels 110 will have female-by-female threaded ends while the tandem sub 125 has opposing male threaded ends.

The perforating gun assembly 100 with its long string of gun barrels (the housings 112 of the perforating guns 110) is carefully assembled at the surface, and then lowered into a wellbore at the end of the e-line 140. The e-line 140 extends upward to a control interface located at the surface. An insulated connection member 130 connects the e-line 140 to the uppermost perforating gun 110. Once the assembly 100 is pumped down to the end of the wellbore, an operator of the control interface sends electrical signals to the perforating gun assembly 100 for detonating the shaped charges 115 and for creating perforations into the casing.

After the charges in the first perforating gun are discharged, the assembly 100 is pulled up the hole to a new location, and new charges are shot. This process is repeated until the desired sections along the horizontal wellbore have been fully perforated. Additional details concerning the perforation operation, and accompanying formation fracturing, are discussed in the parent application and need not be repeated herein.

It is desirable to be able to make up the threaded connections between the gun barrels 110 in the tool string and each tandem sub 125 quickly, at the well site. Accordingly, a new socket driver is disclosed herein for making such a connection. In addition, a method for connecting perforating guns along a perforating gun assembly is provided. The method is carried out at the surface before the tool string 100 is run into the wellbore, using the socket driver.

SUMMARY OF THE INVENTION

A socket driver for a perforating gun assembly is first provided. The perforating gun assembly includes a tandem sub. Beneficially, the socket driver is configured to mate with a shoulder along the tandem sub, allowing an operator to make up the threaded connection manually and quickly.

The socket driver first comprises an elongated tubular body. The tubular body defines a wall, and a bore therein. In one aspect, the socket driver is between 3 and 8 inches in length.

The socket driver also includes a first end, and a second end opposite the first end. The second end defines a second inner diameter, forming a bore. Preferably, the first end comprises a first inner diameter, also forming a bore. The shoulder resides intermediate the first and second ends.

The socket driver additionally includes a radial notched profile. The notched profile is configured to mate with slots machined into the shoulder of the tandem sub. In this way, the socket driver engages the shoulder of the tandem sub so that rotation of the socket driver causes rotation of the connected tandem sub.

In one embodiment, the radial notched profile of the socket driver resides within the second inner diameter. In another embodiment, the radial notched profile of the socket driver extends away from the second end of the socket driver.

In one aspect, the first end of the socket driver comprises an opening configured to receive a torque tool. The torque tool may be, for example, a ratchet head or an Allen wrench. In another aspect, the first end of the socket driver comprises a protruding hex configured to accommodate a wrench or a separate socket.

A method of connecting ends of perforating guns is also provided herein. The method uses the socket driver described above, in its various embodiments.

The method first comprises providing a tandem sub. The tandem sub may be, for example, between 5 and 8 inches in length. The tandem sub has:

a first end defining first end threads, a second end defining second end threads, a bore extending from the first end to the second end, and an enlarged shoulder intermediate the first and second ends, the shoulder having slots forming a radial "toothed" pattern;

The method also includes providing a first perforating gun. The first perforating gun has:

a gun barrel housing, a carrier tube residing within the gun barrel housing, and a plurality of shape charges residing along the carrier tube;

Preferably, the carrier tube of the first perforating gun comprises a signal line in electrical communication with a surface control, and a detonator. Preferably, the tandem sub houses an addressable switch.

The method further includes providing a second perforating gun. The second perforating gun also comprises:

a gun barrel housing, a carrier tube residing within the gun barrel housing, and a plurality of shape charges residing along the carrier tube;

The method further includes sliding the first end threads of the tandem sub into an end of the gun barrel housing of the first perforating gun. The method may then comprise sliding the second end of the socket driver over the second end threads of the tandem sub to engage the notched profile of the socket driver with the slots along the shoulder of the tandem sub.

The method may then include applying rotation of the socket driver relative to the first perforating gun to make a threaded connection between the tandem sub and the first perforating gun. Specifically, the tandem sub is made up to the gun barrel housing. Preferably, the gun barrel housing is held in place by means of a vice while the tandem sub is "made up" onto the gun barrel housing.

In one embodiment, the method further comprises sliding a first end of the gun barrel housing of the second perforating gun onto the second end threads of the tandem sub. This is done while the first perforating gun remains secure within the vice. The method then includes at least partially hand-tightening the second perforating gun onto the tandem sub.

Optionally, a second tandem sub is threadedly placed into a second end of the gun barrel housing of the second perforating gun, opposite the original tandem sub. The second tandem sub also includes slots along an intermediate shoulder. The socket driver is then slid over the second end threads of the second tandem sub to engage the notched profile of the socket driver with the slots along the shoulder of the second tandem sub.

The method may then include applying rotation of the socket driver relative to the first perforating gun to make a threaded connection between the second tandem sub and the second perforating gun. Note that this action will both tighten the second tandem sub onto the second perforating gun and tighten the second perforating gun to the original tandem sub. Thus, the gun barrels are threaded onto the opposing male ends of the original tandem sub until they reach the intermediate shoulder.

The gun barrels have female threads that connect to the first and second male threads of the tandem sub.

In one technical aspect of the method, the tandem sub holds an addressable switch. The addressable switch is configured to receive instruction signals from the surface by means of the signal line. The addressable switch listens for a detonation signal that is associated with that tandem sub. Upon command, the addressable switch transmits a detonation signal to the detonator in the first perforating gun. The detonator, in turn, ignites an explosive material, creating an explosion that is passed through a detonating cord. The detonating cord then ignites shaped charges along the first perforating gun.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DEFINITIONS

Figure 1:
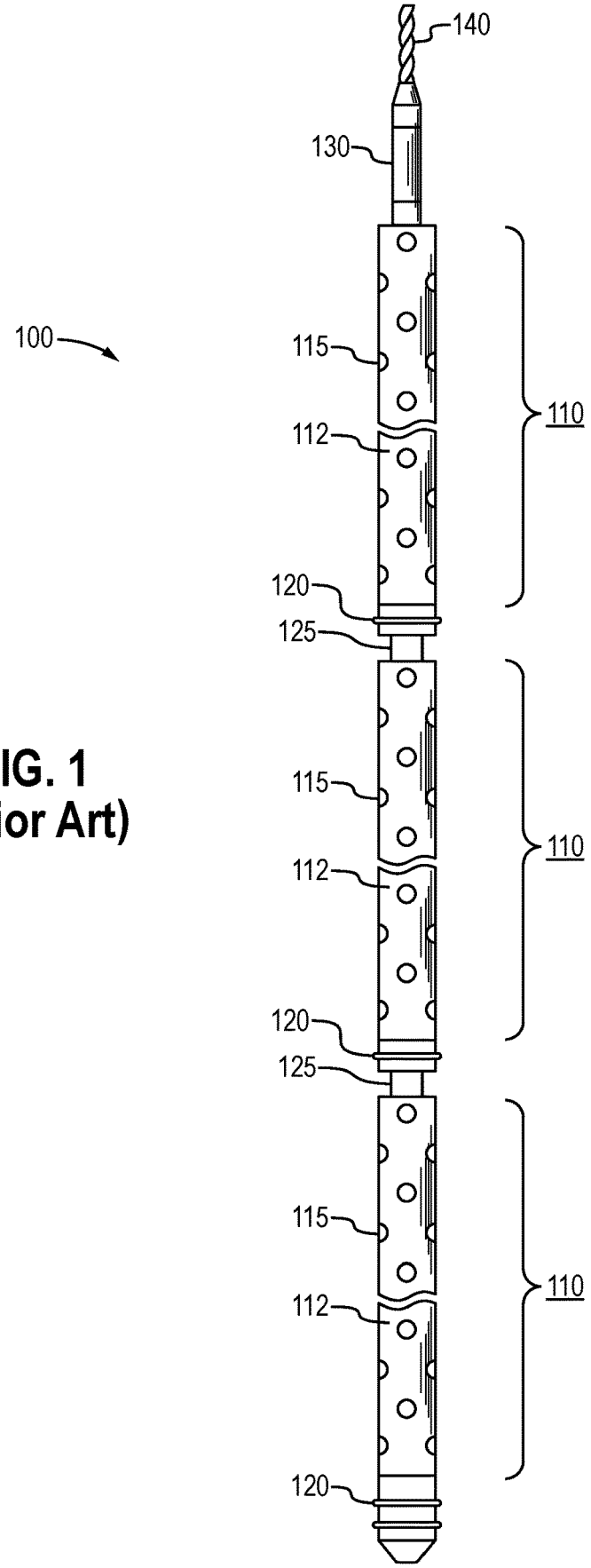
FIG. 1 (Prior Art)
FIG. 1 is a side view of a perforating gun assembly. The perforating gun assembly represents a series of perforating guns having been threadedly connected end-to-end. Tandem subs are shown between gun barrels of the perforating guns, providing the threaded connections.

For purposes of the present application, it will be understood that the term "hand-tightening" or "hand tightened" does not require the operator to completely thread the end of a first tubular body onto the end of a second tubular body to make up a joint. Rather, "hand-tightening" may include loosely aligning two tubular bodies, and optionally making a first ¼ turn to start the threading process.

As used herein, the term "hydrocarbon" refers to an organic compound that includes primarily, if not exclusively, the elements hydrogen and carbon. Hydrocarbons may also include other elements, such as, but not limited to, halogens, metallic elements, nitrogen, carbon dioxide, and/or sulfuric components such as hydrogen sulfide.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, nitrogen, carbon dioxide, hydrogen sulfide and water.

As used herein, the term "fluid" refers to gases, liquids, and combinations of gases and liquids, as well as to combinations of gases and solids, combinations of liquids and solids, and combinations of gases, liquids, and solids.

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface region.

As used herein, the term "wellbore" refers to a hole in the subsurface made by drilling or insertion of a conduit into the subsurface. A wellbore may have a substantially circular cross section, or other cross-sectional shapes. The term "well," when referring to an opening in the formation, may be used interchangeably with the term "wellbore."

Reference herein to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment.

DETAILED DESCRIPTION OF CERTAIN EMBODIMENTS

The following description of the embodiments refers to the accompanying drawings. The same reference numbers in different drawings identify the same or similar elements. The following detailed description does not limit the invention; instead, the scope of the invention is defined by the appended claims.

The following embodiments are discussed, for simplicity, with regard to attaching two perforating guns to each other through a tandem sub. In the following, the terms "upstream" and "downstream" or "first" and "second" are being used to indicate that one gun barrel housing of a perforating gun may be situated above and one below, respectively. However, one skilled in the art would understand that the invention is not limited only to the upstream gun or only to the downstream gun, but in fact can be applied to either gun. In other words, the terms "upstream" and "downstream" are not necessarily used in a restrictive manner, but only to indicate, in a specific embodiment, the relative positions of perforating guns or other components.

Figure 2:
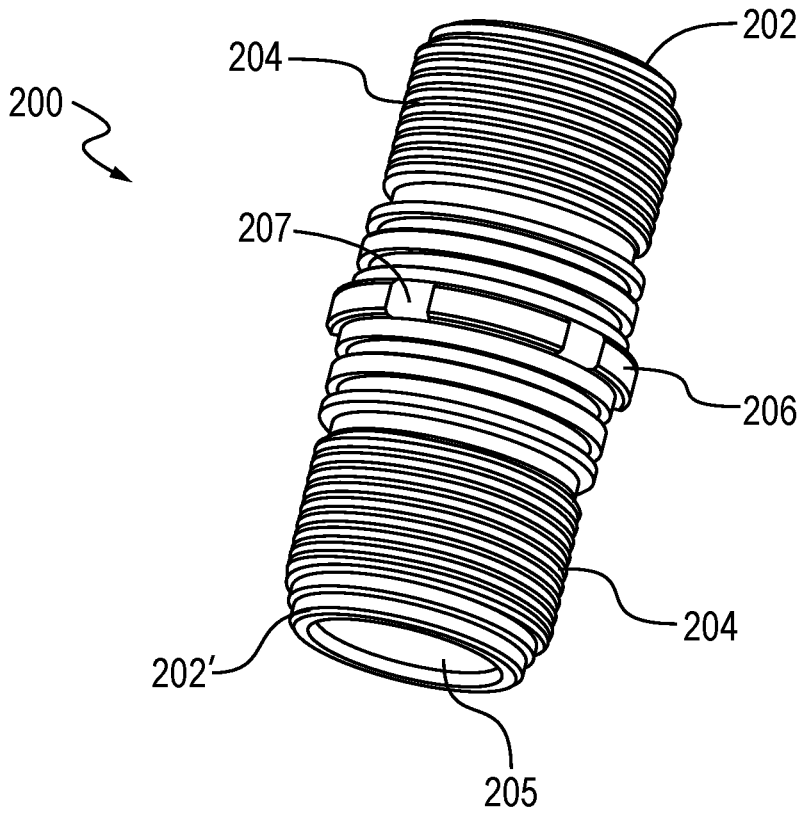
FIG. 2 is a perspective view of a tandem sub of the present invention, in one embodiment.

FIG. 2 is a perspective view of an illustrative tandem sub 200. The tandem sub 200 defines a short tubular body having a first end 202 and a second opposing end 202'. The first end 202 represents a first end threads end while the second end 202' represents a second end threads.

The tandem sub 200 may be, for example, 3.0 inches to 8.5 inches in length, with the two ends 202, 202' being mirror images of one another. Preferably, the tandem sub 200 is between 5.0 and 8.0 inches in length. Preferably, the tubular body forming the tandem sub 200 is portless, as shown in FIG. 2.

The tandem sub 200 includes externally machined threads 204. The threads 204 are male threads dimensioned to mate with female threaded ends of a gun barrel housing, such as perforating guns 310, 310' shown in FIG. 3 of the parent application. The tandem sub 200 is preferably dimensioned in accordance with standard 3⅛" gun components. This allows the tandem sub 200 to be threadedly connected in series with perforating guns from any American vendor, e.g., Geo-Dynamics® and Titan®.

Interestingly, if the operator begins having multiple misruns due to a problem with the detonator, then the portless tandem sub 200 (and internal electronic assembly 400, described below) allow the operator to switch to a new batch number, or even to switch vendors completely. The detonation system of the parent application also allows the operator to select the gun lengths, shot densities and phasing that are available on the market. Thus, a plug-n-play system that may be used with perf guns from different vendors is provided.

Intermediate the length of the tandem sub 200 and between the threads 204 is a shoulder 206. The shoulder 206 serves as a stop member as the tandem sub 200 is screwed into the end of a gun barrel housing 110.

Of interest, slots 207 are formed equi-radially around the shoulder 206. The slots 207 cooperate with a socket driver (described below in FIGS. 3A and 4A) used for applying a rotational force to the tandem sub 200 without harming the rugosity of the shoulder 206. The slots 207 in the shoulder 206 form a toothed radial profile. In one optional aspect, the slots 207 are equi-distantly spaced around the shoulder 206.

The tandem sub 200 includes a central bore 205. As described in detail in the parent application and as partially shown in FIG. 8 herein, the bore 205 is dimensioned to hold novel electronics associated with a perforating gun assembly. Such electronics represent an electronic switch housing as shown at 650 in FIG. 8, an addressable switch 660 shown in FIG. 8 and also in FIG. 13 of the parent application, a contact pin 670 shown in FIGS. 14 and 21 of the parent application, a signal transmission pin 720', a detonator pin 720", and a ground pin 710 shown together in FIG. 7A.

Figure 3A:
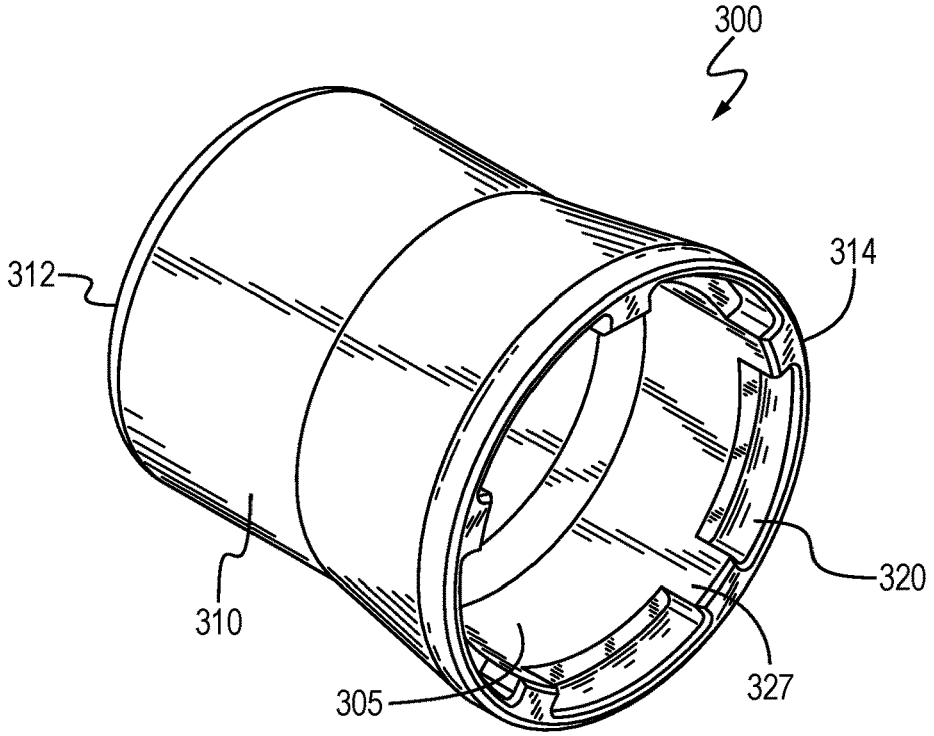
FIG. 3A is a perspective view of a socket driver of the present invention, in a first embodiment. The socket driver is seen from a second end.
Figure 3B:
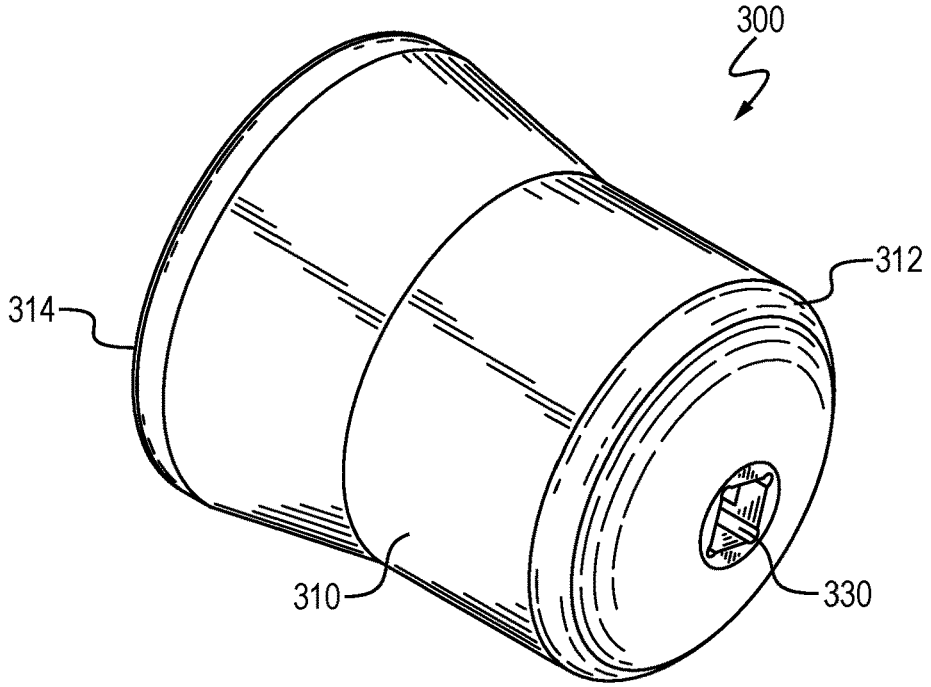
FIG. 3B is an end view of the socket driver of FIG. 3A, seen from a first end which is opposite the second end. An opening is seen in the first end.

FIG. 3A presents a perspective view of a socket driver 300 of the present invention, in a first embodiment. The socket driver 300 is shown from a second end 314. FIG. 3B is a perspective view of the socket driver 300 of FIG. 3A, but now seen from a first end 312. The socket driver 300 will be introduced with reference to FIGS. 3A and 3B, together.

The socket driver 300 defines an elongated tubular body 310 forming a wall. A bore 305 resides along a length of the wall 310. The tubular body 310 has a first end 312, and a second end 314 opposite the first end 312. The bore 305 represents a first inner diameter proximate the first end 312, and a second inner diameter proximate the second end 314. In the illustrative arrangement of FIGS. 3A and 3B, the second inner diameter is greater than the first inner diameter.

A radial notched profile 320 is provided at the second end 314 of the tubular body 310. Beneficially, the notched profile 320 is configured to mate with the radial notched profile of the tandem sub 200. In this regard, the radial notched profile 320 includes teeth 327 dimensioned to fit within the slots 207 along the shoulder 206 of the tandem sub 200.

The first end 312 of the socket driver 300 comprises an opening 330. The opening 330 is configured to receive a torque tool (not shown). The torque tool may be, for example, a standard ratchet head, a star tip tool, or an Allen wrench. The torque tool is used to provide relative rotation of the socket driver 300 to a tandem sub 212.

Figure 3C:
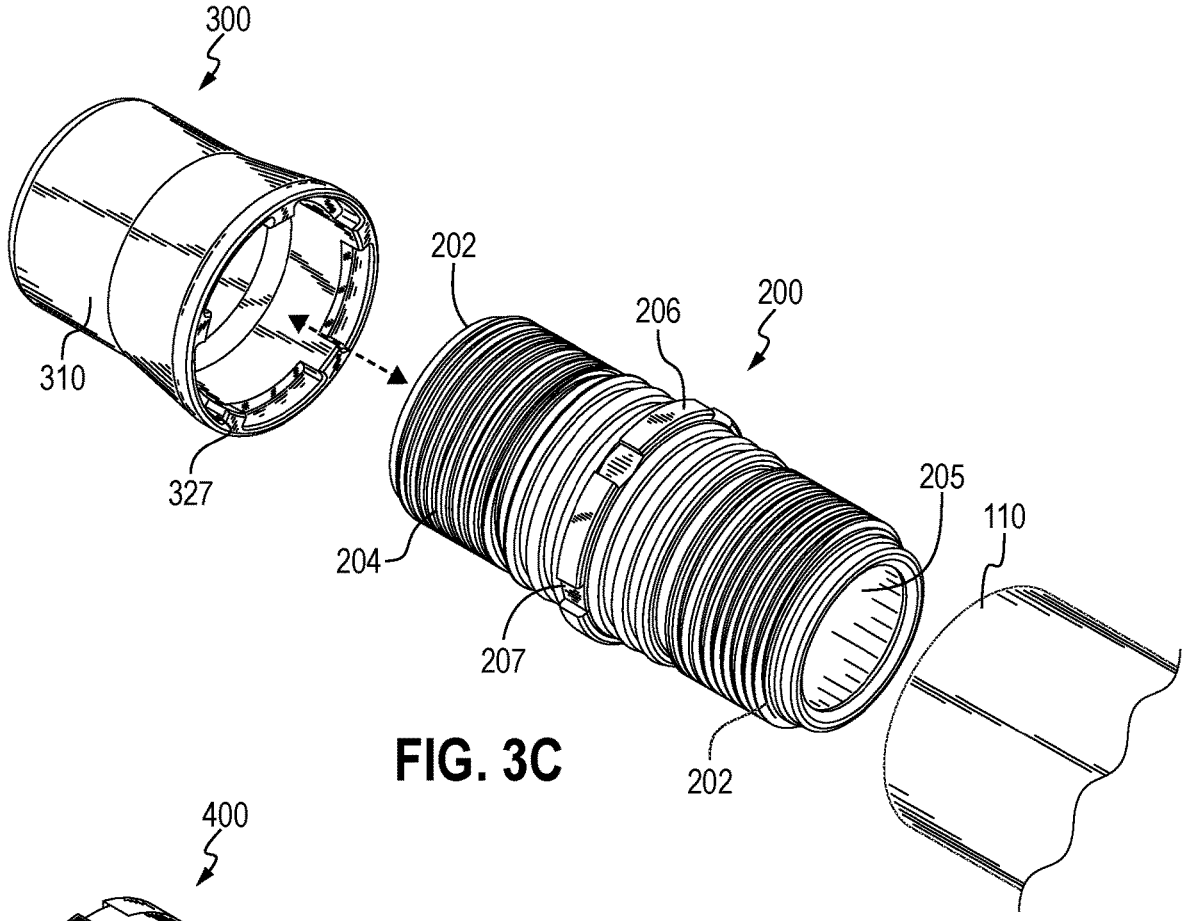
FIG. 3C is an end view of the socket driver of FIG. 3A. The socket driver is in exploded-apart relation to the tandem sub of FIG. 2.

FIG. 3C is a perspective view of the socket driver 300 in exploded-apart relation to the tandem sub 200. The inner diameter within the second end 314 of the socket driver 300 is dimensioned to slidably receive a threaded end of the tandem sub 200.

Figure 3D:
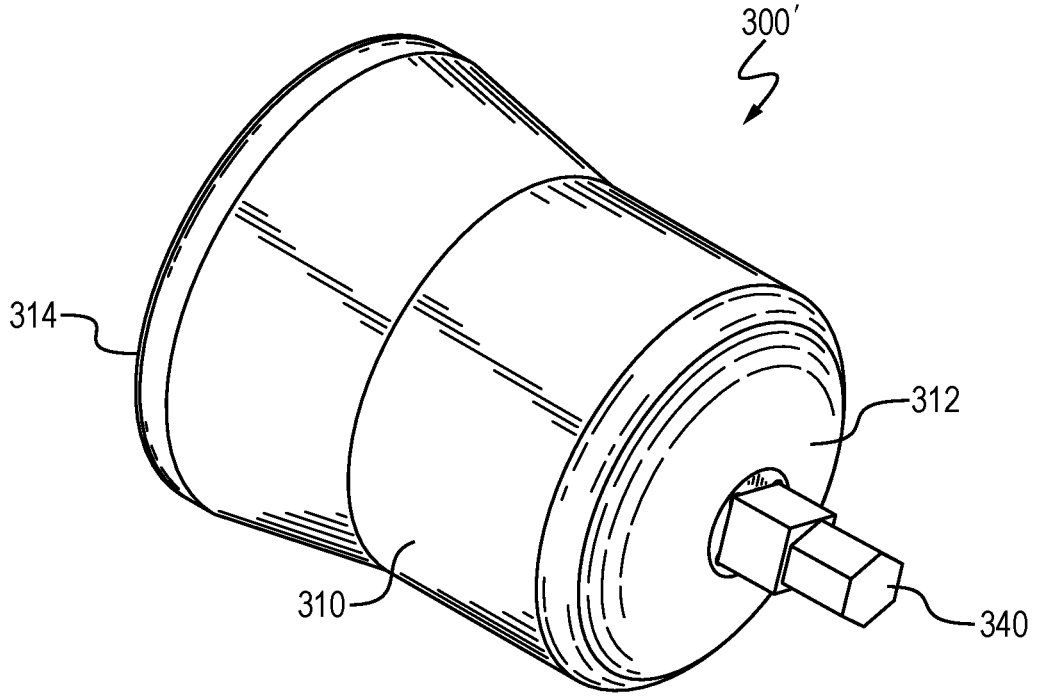
FIG. 3D is a perspective view of the socket driver of FIG. 3B. In this view, a hex head is shown extending from the first end.

In an alternate embodiment of the socket driver 300 of FIG. 3B, the first end 312 of the socket driver 300 comprises a protruding hex. FIG. 3D is a perspective view of such a socket driver 300'. In this view, a hex head 340 is shown extending from the first end 312. The protruding hex 340 is configured to accommodate a wrench. The wrench (not shown) may be a closed-end (or box) wrench, an open-end wrench, or a so-called N-wrench.

In the arrangement of FIG. 3A, the radial notched profile 320 of the socket driver 300 resides as a shoulder within the second inner diameter. However, the radial notched profile may alternatively extend out from the second end.

Figure 4C:
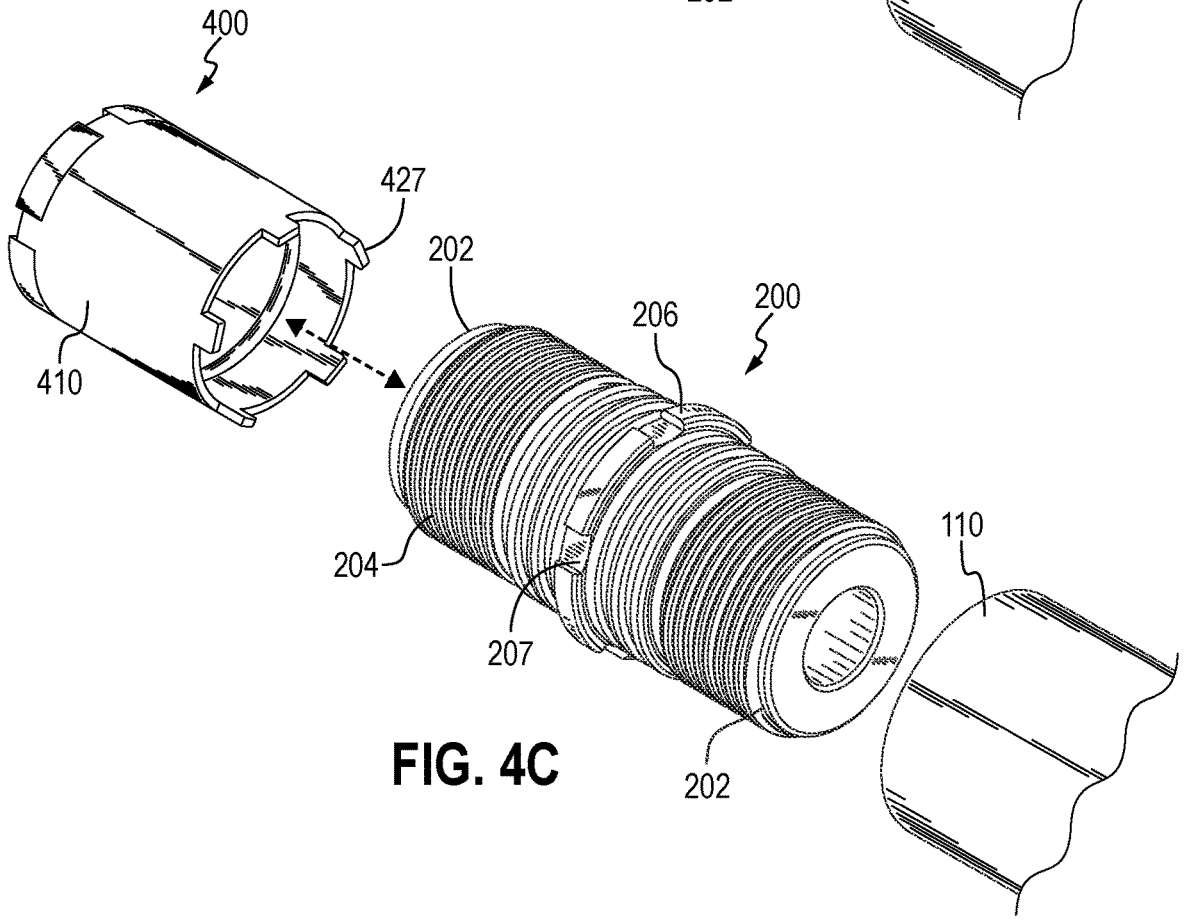
FIG. 4C is an end view of the socket driver of FIG. 4A. The socket driver is in exploded-apart relation to the tandem sub of FIG. 2.
Figure 4A:
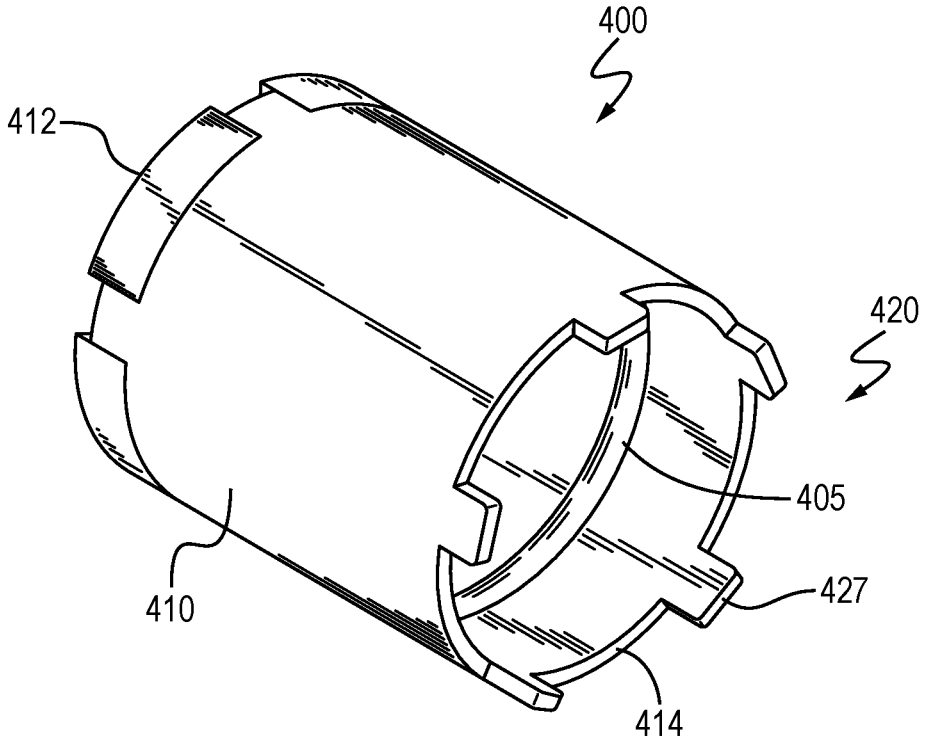
FIG. 4A is a perspective view of a socket driver of the present invention, in a second embodiment. The socket driver is seen from a second end.
Figure 4B:
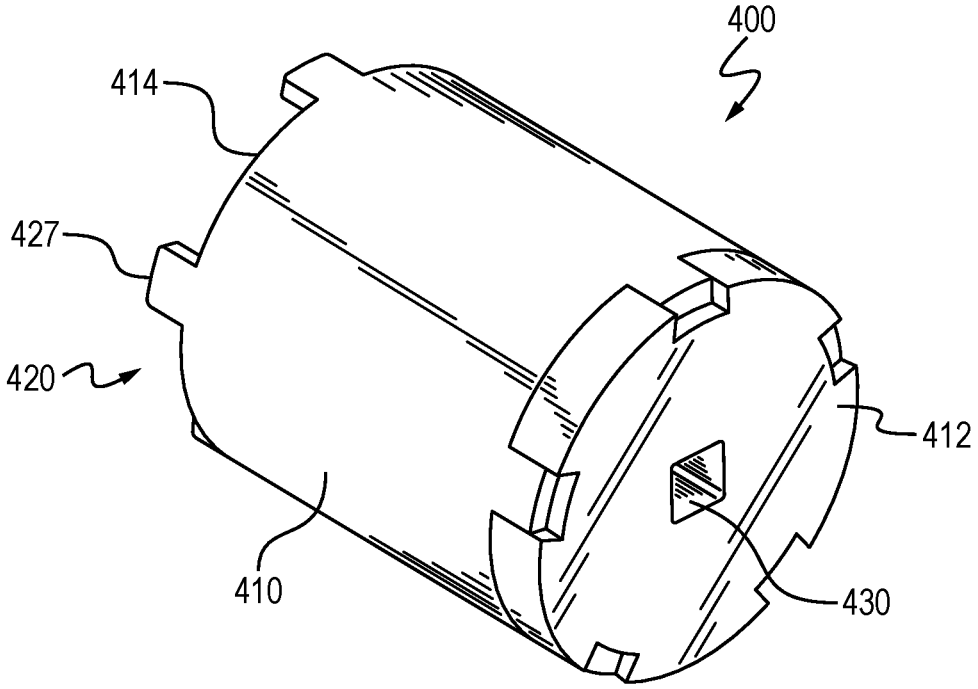
FIG. 4B is an end view of the socket driver of FIG. 4A, seen from a first end which is opposite the second end. An opening is seen in the first end.

FIG. 4A presents a perspective view of a socket driver 400 of the present invention, in such a second embodiment. The socket driver 400 is shown from a second end 414. FIG. 4B is a perspective view of the socket driver 400 of FIG. 4A, but now seen from a first end 412. The socket driver 400 will be discussed with reference to FIGS. 4A and 4B, together.

The socket driver 400 defines an elongated tubular body 410 forming a wall. A bore 405 resides along at least a portion of the wall 410 proximate the second end 414.

A radial notched profile 420 is provided at the second end 414 of the tubular body 410. Beneficially, the notched profile 420 is configured to mate with the radial notched profile, e.g., slots 207, along the shoulder 206 of the tandem sub 200. In the arrangement of FIG. 4A, the radial notched profile 420 extends from second end 414 of the socket driver 400. In addition, the bore 405 resides along the second end 414 of the tubular body 410 and is long enough to encapsulate threads along the tandem sub 200.

The first end 412 of the socket driver 400 optionally comprises an opening 430. The opening 430 is configured to receive a torque tool (not shown). The torque tool may be, for example, a standard ratchet head or an Allen wrench.

FIG. 4C is perspective view of the socket driver 400 in exploded-apart relation to the tandem sub 200. The inner diameter within the second end 414 of the socket driver 400 is dimensioned to receive a threaded end of the tandem sub 200.

Figure 4D:
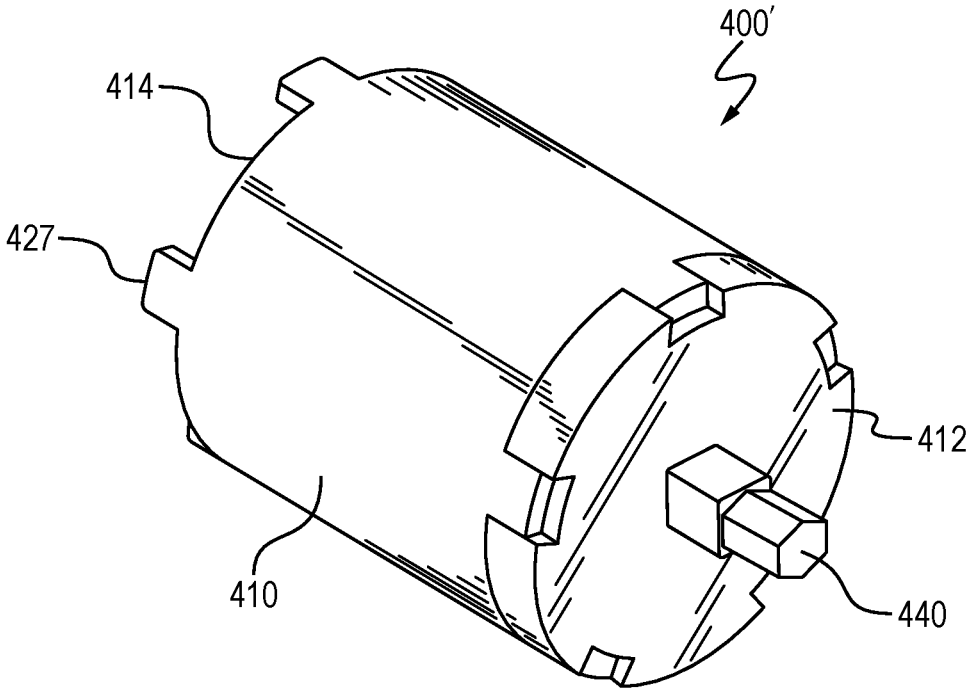
FIG. 4D is a perspective view of the socket driver of FIG. 4B. In this view, a hex head is shown extending from the first end.

In an alternate embodiment of the socket driver 400 of FIG. 4B, the first end 412 of the socket driver 400 comprises a protruding hex. FIG. 4D is a perspective view of such a socket driver 400'. In this view, a hex head 440 is shown extending from the first end 412. The protruding hex 440 is again configured to accommodate a wrench or, optionally, is configured to receive a separate socket for turning by a ratchet.

Figure 5:
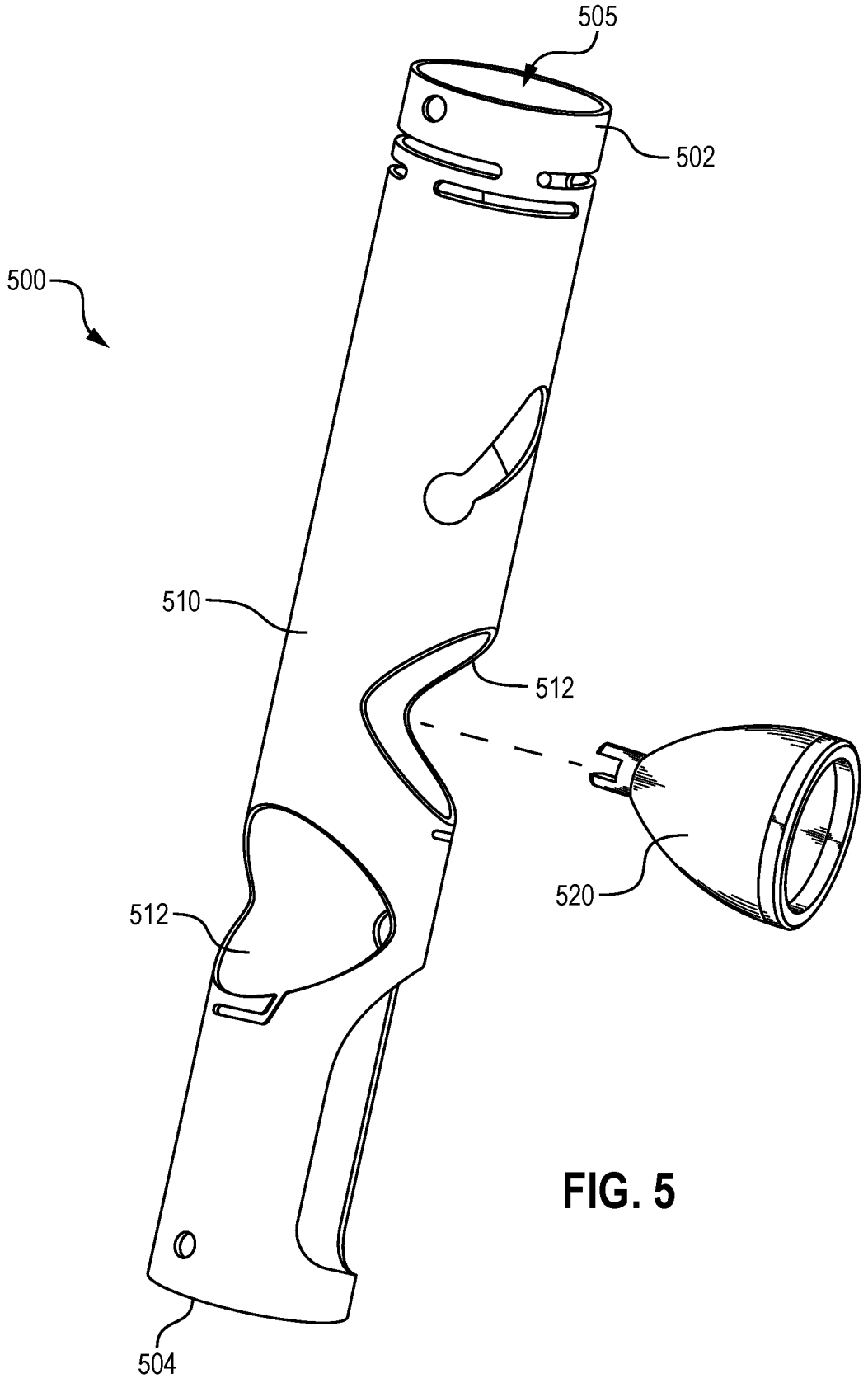
FIG. 5 is a perspective view of an illustrative carrier tube for a perforating gun. A charge is shown in separated relation.

FIG. 5 is a perspective view of an illustrative carrier tube 500 for a perforating gun 110. The carrier tube 500 defines an elongated tubular body 510 having a first end 502 and a second opposing end 504. The carrier tube 500 has an inner bore 505 dimensioned to receive charges. A single illustrative charge is shown at 520 in exploded-apart relation. Openings 512 are provided for receiving the charges 520 and enabling the charges 520 to penetrate a surrounding casing string upon detonation.

Figure 6A:
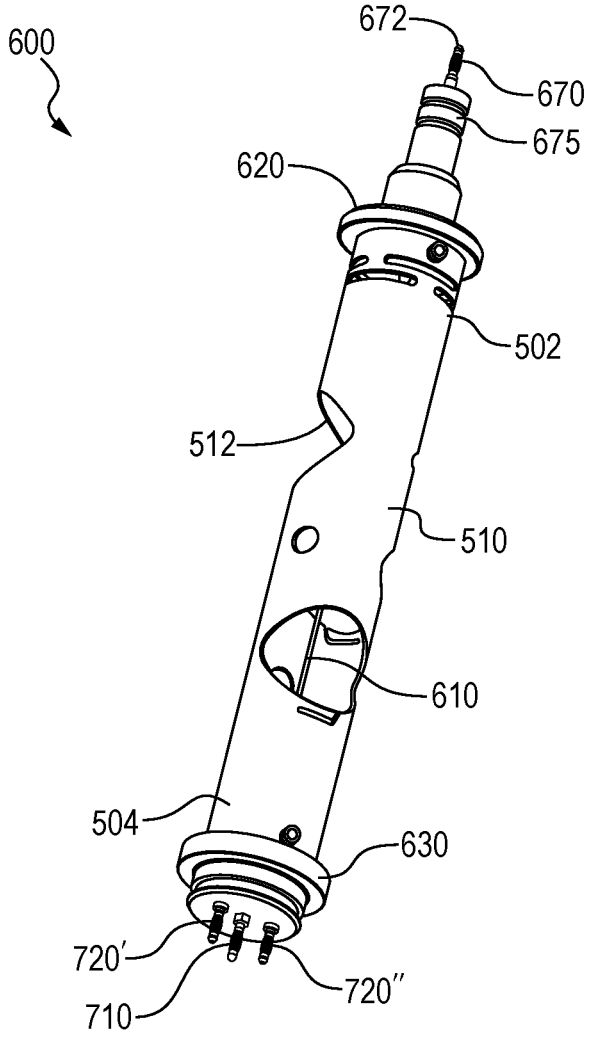
FIG. 6A is a perspective view of the carrier tube of FIG. 5. The carrier tube has received a top end plate and a bottom end plate. An electric line is shown extending through the carrier tube and to the bottom end plate.

FIG. 6A is a perspective view of the carrier tube 500 of FIG. 5. In this view, a pair of end plates have been threadedly connected to opposing ends of the carrier tube 500. These represent a top end plate 620 connected at a top end 502, and a bottom end plate 630 connected at the bottom end 504. The end plates 620, 630 have mechanically enclosed the top 502 and bottom 504 ends of the carrier tube 500, respectively. The end plates 620, 630 help center the carrier tube 500 and its charges 520 within an outer gun barrel (not shown in FIG. 6A but shown at 110 in FIG. 6B). The end plates 620, 630 along with the bulkhead 685 also serve to provide a pressure seal from the explosive charges being detonated in the wellbore, thereby preserving the electronics residing inside of the adjoining tandem subs 200.

It is understood that each opening 512 along the carrier tube 500 will receive and accommodate a shaped charge 520. Each shaped charge 520, in turn, is designed to detonate in response to an explosive signal passed through a detonating cord. It is understood that the carrier tube 500 and the shaped charge 520 are illustrative, and that the current inventions are not limited to any particular type, model or configuration of charges, carrier tubes or gun barrels unless expressly so provided in the claims.

An electronic detonator and a detonating cord (shown at 594 and 595, respectively, in FIG. 25C of the parent application) reside inside the carrier tube 500. The carrier tube 500 and charges 520 together with the gun barrel 112 form a perforating gun (indicated at 110 in FIG. 1) while the perforating gun 110 along with the portless tandem sub 200, the end plates 620, 630, the detonator 594, the detonating cord 595, the addressable switch 660 and the electrical pins 720', 720" form a perforating gun assembly 600.

Extending up from the top end plate 620 is a bulkhead 675. The bulkhead 675 encloses a contact pin 670. The contact pin 670 is configured to transmit detonation and communication signals from the surface, down to addressable switches along the perforating gun string. In the arrangement of FIG. 6A, the carrier tube 510 is downstream from the contact pin 670.

A signal transmission line 610, or communication line, is seen extending down from the contact pin 670 and through the carrier tube 500. The signal line 610 further extends through the bottom end plate 630, and will extend down to a next perforating gun (not shown). Of interest, the signal line 610 is interrupted at the bottom end plate 630 by a transmission pin 720'. The transmission pin 720' is shown in greater detail in FIG. 7A.

Figure 6B:
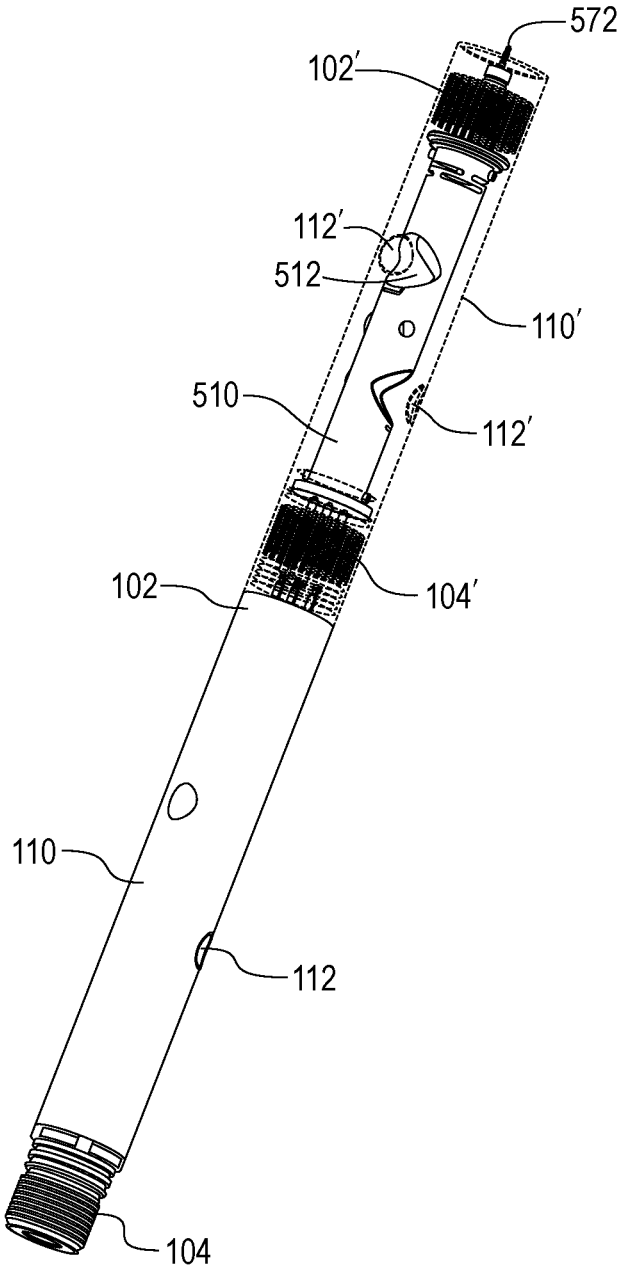
FIG. 6B is another perspective view of the carrier tube of FIG. 5. The carrier tube is slidably receiving a gun barrel housing.

FIG. 6B is another perspective view of the carrier tube 500 of FIG. 5. Here, the carrier tube 500 is slidably receiving a gun barrel housing 110. The gun barrel housing 110 has an upper end 102 and a lower end 104. The gun barrel housing 110 has a length that is generally conterminous with the length of the carrier tube 500. The gun barrel housing 110 includes openings 112 that align with openings 512 of the carrier tube 500 when the gun barrel housing 110 is slid in place over the carrier tube 500.

In the view of FIG. 6B, the gun barrel housing 110 is shown in phantom when placed over the carrier tube 500. The upper end is indicated at 102' while the lower end is shown at 104'. Scallops along the gun barrel housing 110 are provided at 112'. It is understood that this assembly typically takes place at the shop before delivery of a perforating gun assembly to a well site.

Figure 7A:
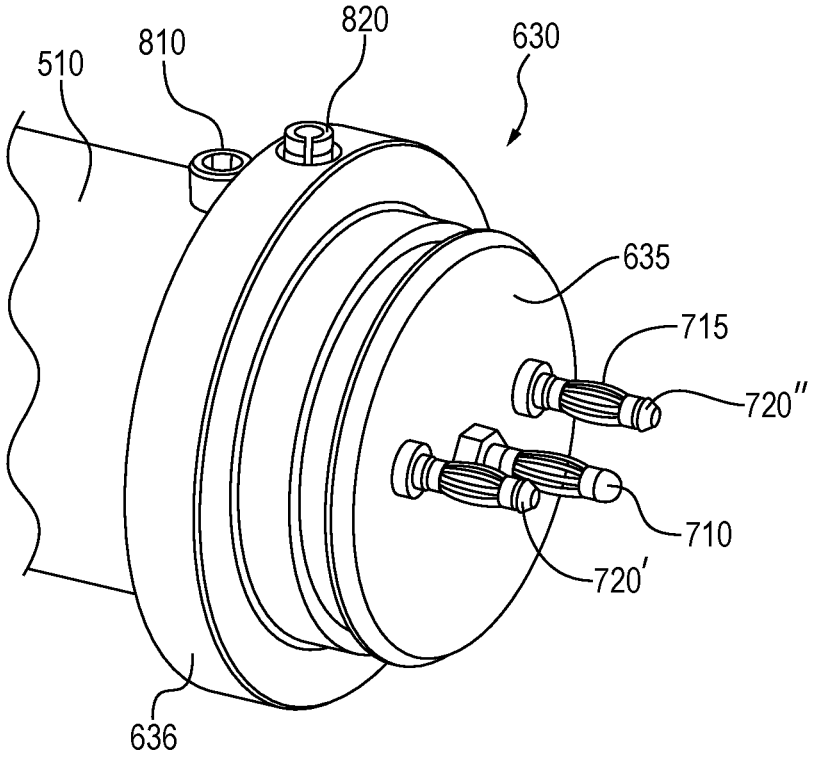
FIG. 7A is a first perspective view of the bottom end plate of FIG. 6A. The end plate is connected to the carrier tube. Three electrical pins are shown extending out of the end plate.

FIG. 7A is a first perspective view of the bottom end plate 630 of FIG. 6A. The end plate 630 is slidably connected to the body 510 of the carrier tube 500 at end 504. Bolt 810 threadedly connects a proximal end (shown at 632 in FIG. 9B) to the lower end 504 of the carrier tube 500.

Figure 9A:
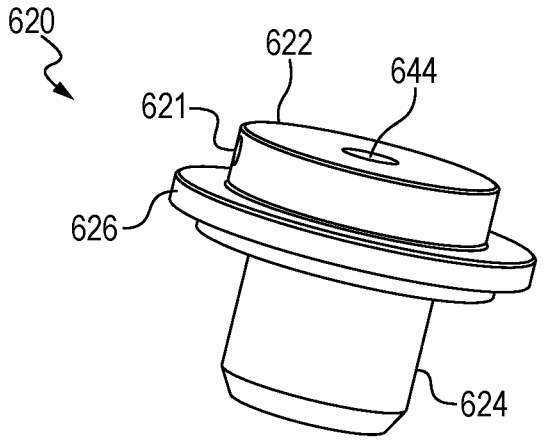
FIG. 9A is a perspective view of a top end plate that is part of the perforating gun assembly. The top end plate seats against the downstream end of the tandem sub.
Figure 9B:
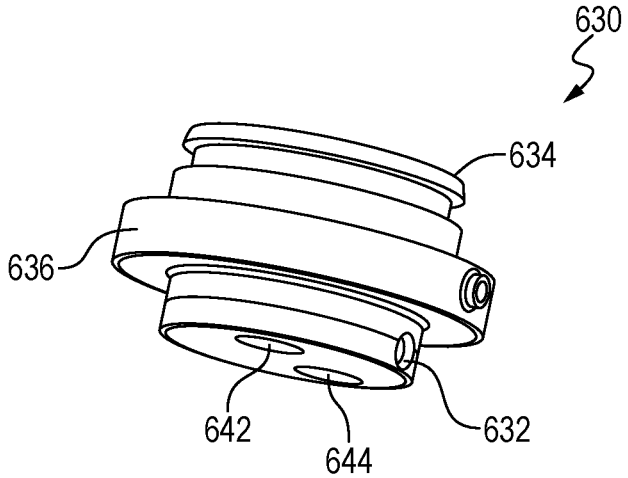
FIG. 9B is a perspective view of a bottom end plate that is part of the perforating gun assembly. The bottom end plate seats against the upstream end of the tandem sub.

The end plate 630 has a closed end surface 635. Three separate pins are seen extending out of the closed end surface 635. These represent a ground pin 710 and two electrical pins 720', 720". In one aspect, ground pin 710 connects to the bottom end plate 630 as an electrical ground, while electrical pins 720', 720" connect to white and green wires, respectively. Enlarged views of the ground pin 710 are shown in FIGS. 9A and 9B of the parent application.

Figure 7B:
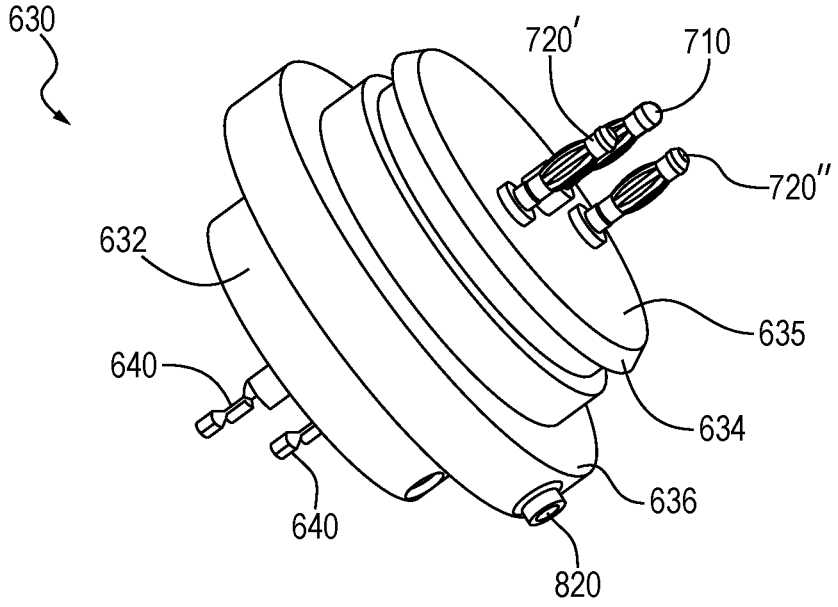
FIG. 7B is a second perspective view of the bottom end plate. The carrier tube has been removed for illustrative purposes.

FIG. 7B is a second perspective view of the bottom end plate 630. In this view, the proximal end 632 and distal end 634 of the plate 630 are visible. Also shown is the closed end surface 635 and a central flange 636. The central flange diameter 632 receives the lowermost end 504 of the carrier tube 500. The central flange 636 also receives bolt 820. In addition, the ground pin 710 and electrical pins 720', 720" are visible.

Note that each of the electrical pins 720', 720" extends into the bottom end plate 630. As demonstrated with pin 680 in FIG. 8 (note that pin 680 and pin 720" are the same transmission pin) each pin is received within a bulkhead 685. Thus, end plate 630 contains two through-openings (shown at 642, 644 in FIG. 9B), each of which receives a bulkhead 685 for securing an electrical pin. Additional details concerning pin 680 are provided in the parent application in connection with FIGS. 22A, 22B, 23A and 23B.

Figure 8:
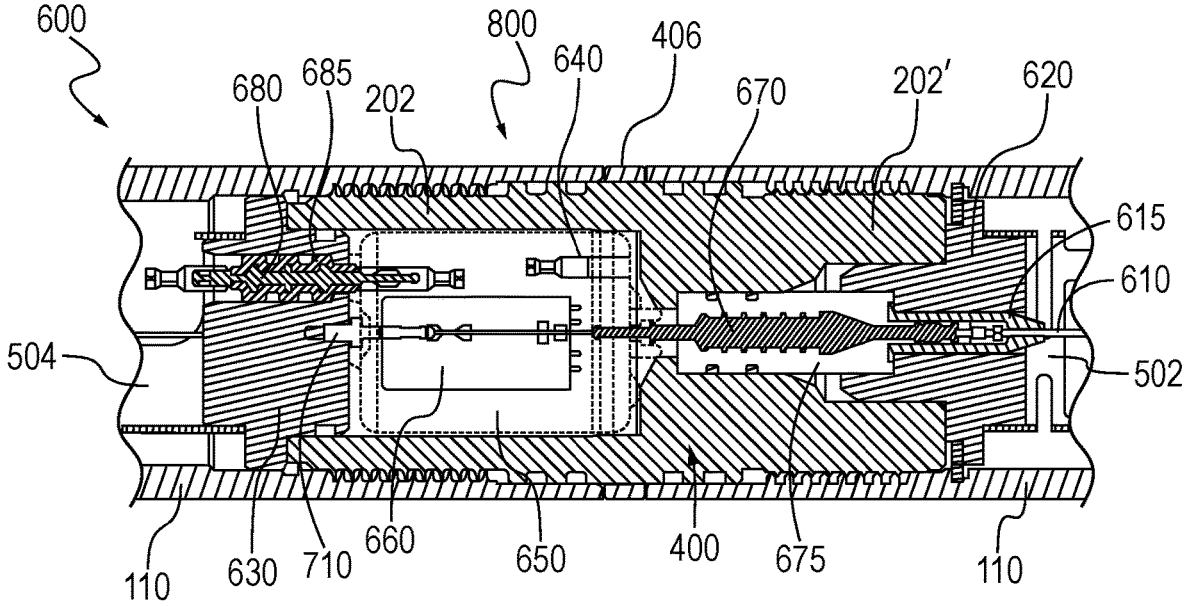
FIG. 8 is a side, cross-sectional view of an explosive initiation assembly of the present invention, in one embodiment. The explosive initiation assembly is threadedly connected at opposing ends to gun barrel housings, forming a perforating gun assembly. The explosive initiation assembly includes, among other components, a tandem sub, a switch housing and an addressable switch.

FIG. 8 is a side, cross-sectional view of an explosive initiation assembly 800 of the present invention, in one embodiment. The explosive initiation assembly 800 is threadedly connected at opposing ends to gun barrel housings 110, forming a part of the perforating gun assembly 600 of FIG. 6A.

The explosive initiation assembly 800 first includes a switch housing 650. The switch housing 650 resides within a bore of the tandem sub 400.

The explosive initiation assembly 800 also includes an addressable switch 660. The addressable switch 660 resides within the switch housing 650. The addressable switch 660 receives signals sent from the surface as sent by an operator, through signal transmission pin 720', and filters those signals to identify an activation signal. If an activation signal is identified, then a signal is separately sent for detonation of charges in an adjacent (typically upstream) perforating gun 110 through detonator pin 720".

Of interest, the detonator is not in electrical communication with the signal line 610, but receives specific signals from the addressable switch 660 through the detonator pin 720" (but indicated in FIG. 8 as 680) which is housed within its own bulkhead in the bottom plate 630.

The tandem sub 200 and its switch housing 650 reside between the bottom plate 630 of the upstream perforating gun 110' and the top end plate 620 of the downstream perforating gun 110. Flange members 636, 626 associated with the bottom end plate 630 and the top end plate 620, respectively, abut opposing ends of the tandem sub 200. Beneficially, the end plates 630, 620 mechanically seal the tandem sub 200, protecting the addressable switch 660 from wellbore fluids and debris generated during detonation of the charges 520.

The explosive initiation assembly 800 also includes a contact pin 670. The contact pin 670 resides within a non-conductive bulkhead 675. A first (or proximal) end of the contact pin 670 extends into the switch housing 650 while a second (or distal) end of the contact pin 670 extends into the top end plate 620. The contact pin 670 and bulkhead 675 are shown in greater detail in FIGS. 14 and 15A of the parent application.

It can be seen that the signal transmission line 610 is connected to the distal end of the contact pin 670. The signal transmission line 610 is protected along the top end plate 620 by means of a tubular insulator 615.

The explosive initiation assembly 800 further includes a detonation pin 680. The detonation pin 680 also resides within a non-conductive bulkhead 685. A proximal end of the detonation pin 680 resides within an adjacent carrier tube 500, while a distal end extends into the switch housing 650. Note that the detonation pin 680 is the same as detonator pin 720" of FIG. 6A. Note also that each of electrical pins 720' and 720" is encased in a bulkhead 685 (although pin 720' is not visible in the cut of FIG. 8).

FIG. 9A is a perspective view of the top end plate 620 that is part of the perforating gun assembly 600, in one embodiment. The top end plate 620 has a proximal end 622 and a distal end 624. Intermediate the proximal 622 and distal 624 ends is the flange 626. As shown in FIG. 8, the downstream end of the tandem sub 200 shoulders out against the flange 626.

The proximal end 622 of the top end plate 620 comprises a threaded opening 621. The threaded opening 621 is configured to receive a bolt or pin (not shown) that radially fixes the top end plate 620 to the top of the carrier tube 510.

FIG. 9B is a perspective view of the bottom end plate 630 that is part of the perforating gun assembly 600, in one embodiment. The bottom end plate 630 seats against the upstream end of the tandem sub 200. The bottom end plate 630 has a proximal end 632 and a distal end 634. Intermediate the proximal 632 and distal 634 ends is a flange 636.

At the proximal end 632 of the end plate 630 are two openings 642, 644. One of the openings 642 is dimensioned to receive the detonation pin 680 (or 720") and the corresponding bulkhead 685. The other opening 644 receives a signal pin 720' and its own corresponding bulkhead 685. Electrical pin 720' serves as a signal transmission pin while electrical pin 720" serves as a detonator pin. Electrical pin 710 serves as a ground pin. The transmission pin 720' and the detonator pin 720" extend from inside the switch housing 650 to inside the bottom end plate 630.

A perspective view of the switch housing 650 is shown in FIG. 12 of the parent application. Likewise, a perspective view of the addressable switch 660 is shown in FIG. 13 of the parent application. Additional details of the switch housing 650 and the addressable switch 660 are provided in the parent application in connection with FIGS. 12, 13, 16 and 17 and need not be repeated herein.

Figure 10:
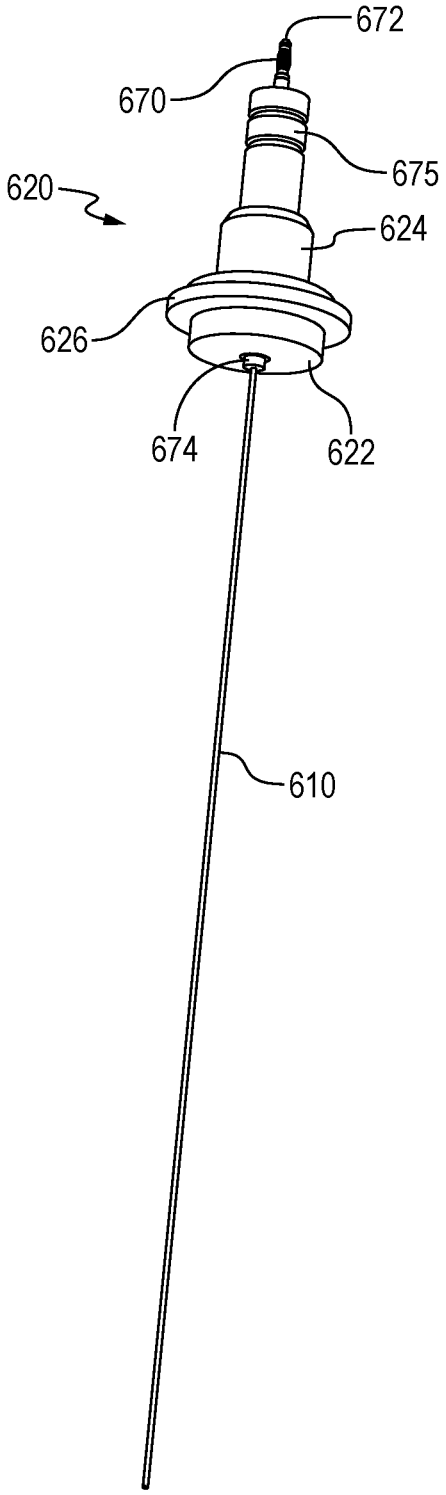
FIG. 10 is a perspective view of a top end plate. A contact pin and supporting bulkhead are seen extending up from the top plate. An electric communication line extends down. The view of FIG. 10 is the same as in FIG. 6A, but with the carrier tube and bottom end plate removed to show the electric line.

FIG. 10 is a perspective view of the top end plate 620. The contact pin 670 and supporting bulkhead 675 are seen extending up from the top plate 620. The signal transmission line 610 is connected to the conductor pin 670 at end 674 and extends down. The view of FIG. 10 is the same as in FIG. 6A, but with the carrier tube 500 and bottom end plate 630 removed to show the signal line 610.

In operation, a detonation signal is sent from the surface 105 through the electric line 240. The signal reaches the perforating gun assembly 600. Typically, a lowest perforating gun is designated for first explosive initiation. In that case, the signal passes along the internal signal transmission line 610 through each perforating gun 210 and is then passed along by the transmission pin 720', the addressable switches 660 in each tandem sub 200, and the contact pins 670 until the signal reaches the lowest tandem sub 200 and its addressable switch 660. The addressable switch 660 then sends a detonation signal back up through the detonator pin 720", through wires 596, and to the detonator 594 (shown in the parent application).

As another way of expressing the sequence, an IE signal enters the perforating gun assembly via a big bulkhead, passes down the carrier tube, goes through the transmission pin and into the addressable switch. If a detonation signal is present, a separate detonation signal is sent back upstream through the detonator pin and into the detonator. Otherwise, it can continue downstream from the addressable switch through the contact pin and to the next perforating gun. The process then repeats.

As can be seen, a novel detonation is provided. Of interest herein, the detonation system includes a tandem sub. The tandem sub defines a generally tubular body having a first threaded end and a second threaded end, wherein each end each comprises male connectors. This allows the tandem sub to be threadedly connected, in series, to respective perforating guns. Thus, the first end is threadedly connected to a first perforating gun (or, more precisely, a female threaded end of a gun barrel), while the second end is threadedly connected to a second perforating gun (or, again, a female threaded end of an opposing gun barrel).

All electrical connections for the detonation system may be made at the gun building facility, that is, except for the wires being connected to the detonator. The end plate on the gun barrel (or gun carrier) is removed, and the pre-wired electronic switch assembly (that is, the switch housing 650 and encapsulated switch 660) is installed. Beneficially, the bulkheads for the two electrical signal pins 720', 720" associated with the bottom end plate 630 are pre-installed into the bottom end plate 630, with the bottom end plate 630 being easily slid against the upstream end 402 of the tandem sub 400. The pre-wired switch assembly can be tested at the gun building facility to reduce the chance of a mis-wired connection.

In addition to the socket driver and the detonation system discussed above, a method of connecting perforating guns in a perforating gun assembly is provided herein. The method uses the socket driver described above, in its various embodiments.

The method first comprises providing a tandem sub. The tandem sub may be, for example, between 5 and 8 inches in length. The tandem sub serves as a first, or original tandem sub, and has:

a first end defining first end threads, a second end defining second end threads, a bore extending from the first end to the second end, and an enlarged shoulder intermediate the first and second ends, the shoulder having slots forming a radial pattern.

The method also includes providing a first perforating gun. The first perforating gun has:

a gun barrel housing, a carrier tube residing within the gun barrel housing, and a plurality of shape charges residing along the carrier tube;

Preferably, the carrier tube of the first perforating gun comprises a signal transmission line in electrical communication with a surface control. Preferably, the tandem sub houses an addressable switch.

The method further includes providing a second perforating gun. The second perforating gun also comprises:

a gun barrel housing, a carrier tube residing within the gun barrel housing, and a plurality of shape charges residing along the carrier tube;

The method further includes sliding the first end threads of the tandem sub into an end of the gun barrel housing of the first perforating gun. The method may then comprise sliding the second end of the socket driver over the second end threads of the tandem sub to engage the notched profile of the socket driver with the slots along the shoulder of the tandem sub.

The method may then include applying rotation of the socket driver relative to the first perforating gun to make a threaded connection between the tandem sub and the first perforating gun. Specifically, the first tandem sub is made up to the gun barrel housing. Preferably, the gun barrel housing is held in place by means of a vice while the tandem sub is "made up" onto the gun barrel housing.

In one embodiment, the method further comprises sliding a first end of the gun barrel housing of the second perforating gun onto the second end threads of the first tandem sub. This is done while the first perforating gun remains secure within the vice. The method then includes at least partially hand-tightening the second perforating gun onto the first, or original, tandem sub.

Optionally, a second tandem sub is threadedly placed into a second end of the gun barrel housing of the second perforating gun, opposite the original tandem sub. The second tandem sub also includes slots along an intermediate shoulder. The socket driver is then slid over the second end threads of the second tandem sub to engage the notched profile of the socket driver with the slots along the shoulder of the second tandem sub.

The method may then include applying rotation of the socket driver relative to the first perforating gun to make a threaded connection between the second tandem sub and the second perforating gun. Note that this action will simultaneously tighten the second perforating gun to the original tandem sub, while tightening the second tandem sub onto the second perforating gun. Thus, the gun barrels are now threaded onto the opposing male ends of the first tandem sub until they reach the intermediate shoulder.

The gun barrels have female threads that connect to the first and second male threads of the tandem sub.

Here are two sequences of steps that may be taken for connecting the first and second perforating guns:

First Sequence

First perforating gun is placed in a vice;

First threaded end of a first tandem sub is hand-tightened onto a second end of the first perforating gun;

First end of the second perforating gun is hand-tightened onto a second threaded end of the first tandem sub;

First threaded end of the second tandem sub is hand-tightened onto a second end of the second perforating gun, opposite the first tandem sub;

While first perforating gun remains stationary, the socket driver is used to turn the second tandem sub, thereby securely tightening the first perforating gun and the second perforating gun onto the first tandem sub simultaneously.

Second Sequence

First threaded end of a first tandem sub is installed onto an end of a first perforating gun using the socket driver;

Second perforating gun is placed in a vice;

First threaded end of a second tandem sub is hand-tightened onto a second threaded end of the second perforating gun;

First threaded end of second perforating gun is hand-tightened onto a second threaded end of the first tandem sub, opposite the first perforating gun;

While second perforating gun remains stationary, the socket driver is used to turn the first tandem sub, thereby securely tightening the first perforating gun onto the first tandem sub and the second perforating gun, simultaneously; and Repeat for perforating guns/tandem subs at the second end of the second perforating gun to connect perforating gun assemblies into a multiple-selection string.

In an alternative embodiment, a shoulder may also be placed at an end of a perforating gun, that is, along an outer diameter of a gun barrel. Such a shoulder would be configured in the same design as the shoulder 206 of the tandem sub 200. This shoulder may be created with added material protruding from the gun barrel as "teeth" or machined into the gun barrel as "slots."

Figure 11:
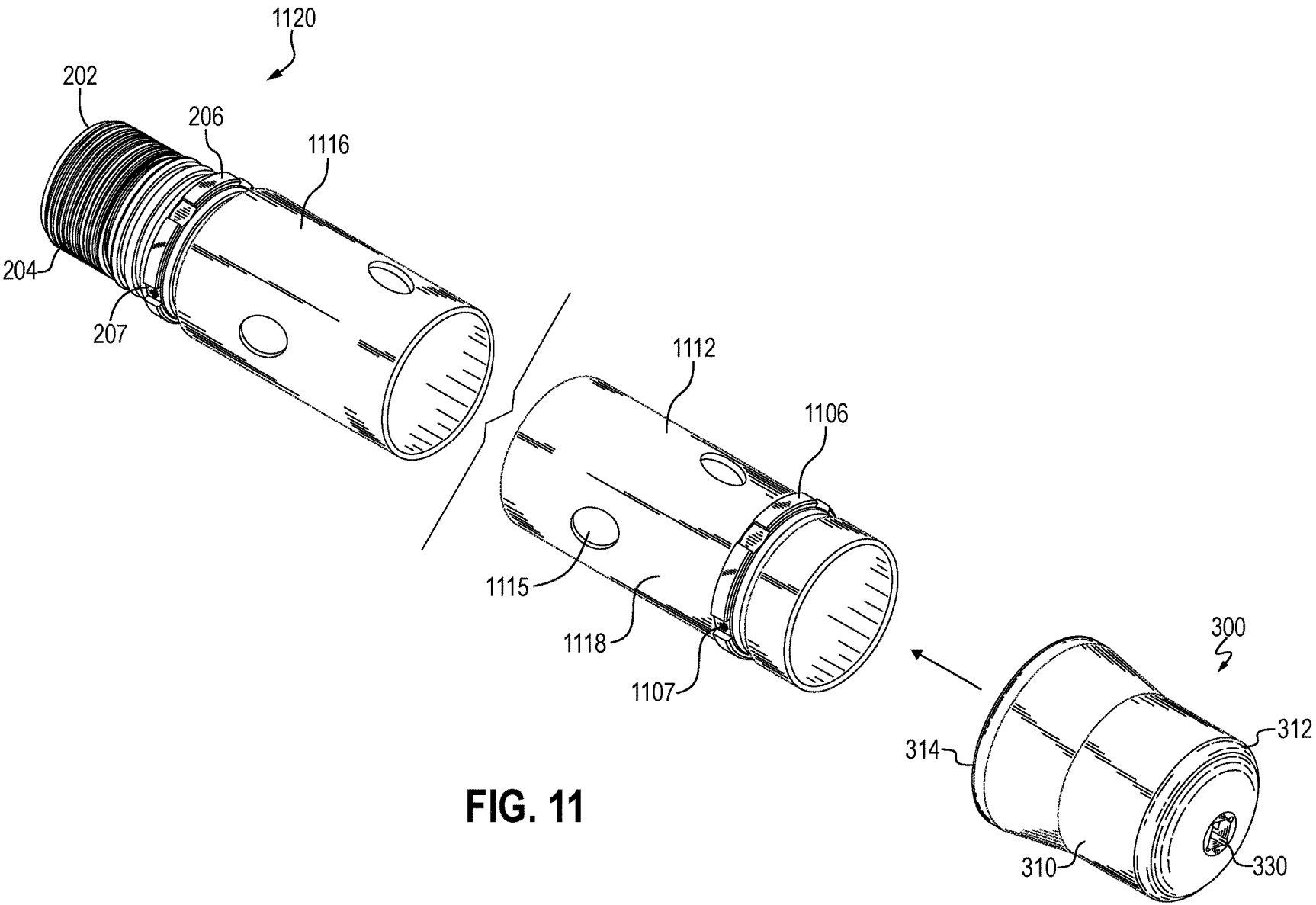
FIG. 11 is a perspective view of an outer gun barrel housing. The gun barrel housing includes a shoulder at one end, with the shoulder having a radial notched profile, or slots, configured to mate with a radial notched profile of a socket driver.

FIG. 11 is a perspective view of an outer gun barrel housing 1112, in an alternate embodiment from those shown at 112 in FIG. 1. The gun barrel housing 1112 has a first end 1116, and a second end 1118 opposite the first end 1116. The gun barrel housing 1112 also includes a plurality of scallops 1115 designed to communicate charges from a carrier tube (such as carrier tube 510 having charges 520 of FIG. 5).

In the view of FIG. 11, the first end 1116 of the gun barrel housing 1112 has received a first tandem sub 1120. The first tandem sub 1120 is in accordance with tandem sub 200 of FIG. 2, described above. The tandem sub 1120 has been tightened onto the first end 1116 of the gun barrel housing 1112 using either of socket driver 300 or 400. Notice that the first end 1116 has threadedly advanced substantially to the intermediate shoulder 206.

The second end 1118 of the gun barrel housing 1112 has received its own shoulder 1106. The shoulder 1106 is in accordance with the shoulder 206. In this respect, shoulder

1106 offers radial slots, 1107 configured to mate with the radial notched profile of the socket driver 300 or 400. Stated another way, as with the shoulder 206 of the tandem sub 200, the shoulder 1106 of the gun barrel comprises slots 1107 equi-distantly spaced around the shoulder 1106 that are dimensioned to receive the teeth 327, 427 of the radial notched profile of the socket driver 300, 400. In this way, the operator may use the socket driver 300, 400 to apply torque directly to a perforating gun 1112 without installing a tandem sub at that end. This arrangement would be of particular benefit to the operator when disassembling guns, or when tightening a last perforating gun to an assembled multiple-selection string.

It is noted that the shoulder 1106 may look like the shoulder 206, but it is not part of a tandem sub. Rather, the shoulder 1106 represents an enlarged area that has been machined into the gun barrel housing 1112 outer diameter. Alternatively, it may be a radial piece that is welded or melded onto the O.D. of the gun barrel housing 1112. Alternatively, the shoulder 1106 may be a metal ring that is adhesively bonded onto the O.D. of the gun barrel housing 1112 or that is mechanically attached. In any instance, the largest outer diameter of the shoulder 1106 may be slightly larger than that of shoulder 206.

In any event, in one technical aspect of the methods, the tandem sub holds an addressable switch. The addressable switch is configured to receive instruction signals from the surface by means of a signal line after the perforating guns and tandem sub have been pumped into a wellbore. The addressable switch listens for a detonation signal that is associated with that tandem sub. Upon command, the addressable switch transmits a detonation signal to the detonator in the first perforating gun. The detonator, in turn, ignites an explosive material, creating an explosion that is passed through a detonating cord. The detonating cord then ignites shaped charges along the first perforating gun.

The method includes activating the upstream perforating gun without damaging the electronic switch assembly in the tandem sub. In operation, the operator will send a control signal from the surface, down the e-line (such as e-line 140 of FIG. 1), and to the signal transmission pin 720'. The control signal defines an instruction signal that is specifically sent via the signal transmission pin 720', and to the addressable switch 660. If the instruction signal is not recognized as a detonation signal for that tandem sub 200, the signal is sent on through the signal transmission line 610 and the contact head 672 residing inside of the switch housing 650. From there, the signal is sent through the contact pin 670 and to a next perforating gun.

On the other hand, if the instruction signal is recognized by the addressable switch 660 as an activation signal, then the switch 660 is armed and a window of time is opened (typically about 30 seconds) in which to send a detonation signal from the surface. As part of the detonation signal, an instruction is sent telling the upstream perforating gun (or the detonator within the upstream perforating gun) to be activated.

A detonation signal is sent from the addressable switch 660 to the detonation pin 680 (or 720"), and then to the detonator 594. Of interest, the detonation pin 680 extends through the bottom end plate 630, and to the detonator 594.

The charges in the upstream perforating gun are detonated. Due to the presence of the end plate 630 and the use of sealed pins 710, 720', 720", the integrity of the switch assembly (that is, the switch housing 650 and encapsulated switch 660) in the tandem sub 200 is preserved and, thus, the switch assembly may be reused for another perforation operation. Similarly, the contact pin 670, the bulkhead 675, and the tandem sub 200 itself are protected for later re-use. Thus, the system does not rely on a bulkhead within the tandem sub for the pressure seal.

Before the detonation of the upstream perforating gun, the electronic switch can feed current down to a next perforating gun (or to a bulkhead associated with a next perforating gun), depending on the instruction.

The disclosed embodiments provide methods and systems for preventing electronics located inside a switch sub from being damaged by detonation of an adjacent perforating gun. It should be understood that this description is not intended to limit the invention.; on the contrary, the exemplary embodiments are intended to cover alternatives, modifications, and equivalents, which are included in the spirit and scope of the invention as defined by the appended claims.

Although the features and elements of the present exemplary embodiments are described in the embodiments in particular combinations, each feature or element can be used alone without the other features and elements of the embodiments or in various combinations with or without other features and elements disclosed herein.

Further, variations of the socket driver and of methods for using the socket driver fall within the spirit of the claims, below. It will be appreciated that the inventions are susceptible to other modifications, variations, and changes without departing from the spirit thereof

I claim:

1. A socket driver configured to mate with a shoulder along a tandem sub for a perforating gun assembly, comprising:

an elongated and non-threaded tubular body defining a wall;

a first end;

a second end opposite the first end and having a second inner diameter; and a radial notched profile placed at the second end and configured to mate with a radial notched profile along the shoulder of the tandem sub such that when the socket driver is rotated, torque is applied to the tandem sub;

and wherein:

the tandem sub comprises:

a first end defining first end threads configured to threadedly connect to an end of a first gun barrel housing, a second end defining second end threads configured to threadedly connect to an end of a second gun barrel housing, and a bore extending from the first end to the second end;

the shoulder of the tandem sub resides intermediate the first and second ends; and the second inner diameter is dimensioned to slide over the first end or the second end of the tandem sub.

2. The socket driver of claim 1, wherein:

the radial notched profile of the socket driver comprises teeth equi-distantly spaced; and the shoulder of the tandem sub comprises slots equi-distantly spaced around the shoulder and dimensioned to receive the teeth of the radial notched profile of the socket driver.

3. The socket driver of claim 2, wherein the radial notched profile of the socket driver resides within the second inner diameter.

4. The socket driver of claim 2, wherein the radial notched profile of the socket driver extends from the second end of the socket driver.

5. The socket driver of claim 2, wherein:

the second inner diameter is further dimensioned to slide over an outer diameter of the first or the second gun barrel housing; and an end of the first or second gun barrel housing also comprises a radial notched profile that is configured to mate with the radial notched profile of the socket driver such that when the socket driver is rotated, torque is applied to the first or second gun barrel housing.

6. The socket driver of claim 2, wherein:

the first end comprises a first inner diameter; and the second inner diameter is larger than the first inner diameter.

7. The socket driver of claim 2, wherein the first end comprises an opening configured to receive a torque tool.

8. The socket driver of claim 7, wherein the torque tool is a ratchet head or an Allen wrench.

9. The socket driver of claim 1, wherein the first end comprises a protruding hex configured to accommodate a wrench.

10. A method of connecting ends of perforating guns, comprising:

providing a tandem sub, the tandem sub having:

a first end defining first end threads, a second end defining second end threads, a bore within at least the second end, and an enlarged shoulder intermediate the first and second ends, the shoulder having slots forming a radial pattern;

providing a first perforating gun, the first perforating gun comprising:

a gun barrel housing, a carrier tube residing within the gun barrel housing, and a plurality of shape charges residing along the carrier tube;

providing a second perforating gun, the second perforating gun also comprising:

a gun barrel housing, a carrier tube residing within the gun barrel housing, and a plurality of shape charges residing along the carrier tube;

providing a socket driver comprising:

an elongated tubular body defining a wall;

a first end, a second end opposite the first end and having a second inner diameter, and a radial notched profile configured to mate with the radial pattern of slots along the shoulder of the tandem sub;

sliding the first end threads of the tandem sub into a first end of the gun barrel housing of the first perforating gun;

sliding the second end of the socket driver over the second end threads of the tandem sub to engage the notched profile of the socket driver with the slots along the shoulder of the tandem sub;

applying rotation of the socket driver relative to the first perforating gun to make a threaded connection between the tandem sub and the first perforating gun.

11. The method of claim 10, wherein:

the radial notched profile of the socket driver comprises teeth equi-distantly spaced around the radial notched profile; and the shoulder of the tandem sub comprises slots equi-distantly spaced around the shoulder and dimensioned to receive the teeth of the radial notched profile of the socket driver.

12. The method of claim 11, wherein the radial notched profile of the socket driver resides within the second inner diameter, or the radial notched profile of the socket driver extends from the second end of the socket driver.

13. The method of claim 11, wherein the first end of the socket driver comprises an opening configured to receive a torque tool.

14. The method of claim 13, wherein the torque tool is a ratchet head or an Allen wrench.

15. The method of claim 11, wherein the first end comprises a protruding hex configured to accommodate a wrench.

16. The method of claim 11, wherein:

the carrier tube of the first perforating gun further comprises a signal line in electrical communication with a surface control, and a detonator;

the first end threads and the second end threads each constitute male threads; and the end of the gun barrel of the first perforating gun constitutes female threads.

17. The method of claim 16, wherein:

the tandem sub houses an addressable switch; and the method further comprises—before sliding the first end threads of the tandem sub into the gun barrel housing of the first perforating gun, placing a lower end plate between the carrier tube of the first perforating gun and the tandem sub, and mechanically connecting the detonator in the first perforating gun with the addressable switch by means of a detonation pin.

18. The method of claim 17, wherein:

the lower end plate sealingly receives a signal transmission pin;

the signal transmission pin is configured to receive detonation and communication signals from a surface by means of the signal line;

the lower end plate also sealingly receives the detonation pin;

the detonation pin is configured to receive detonation signals from the addressable switch, and transmit the detonation signals across the lower end plate and back up to the detonator in the first perforating gun.

19. The method of claim 11, further comprising:

removing the socket driver from the second end threads of the tandem sub;

sliding the second end threads of the tandem sub into a first end of the gun barrel housing of the second perforating gun; and rotating the second perforating gun to make a threaded connection between the tandem sub and the second perforating gun.

20. The method of claim 19, wherein the method further comprises:

before sliding the second end threads of the tandem sub into the end of the gun barrel housing of the second perforating gun, placing an upper end plate between the carrier tube of the second perforating gun and the tandem sub.

21. The method of claim 11, wherein:

the tandem sub at the first end of the gun barrel housing of the first perforating gun is a first tandem sub; and the method further comprises:

rotationally fixing the first perforating gun;

removing the socket driver from the second end threads of the first tandem sub;

sliding a first end of the gun barrel housing of the second perforating gun onto the second end threads of the first tandem sub;

at least partially hand-tightening the second perforating gun onto the second end threads of the first tandem sub;

sliding first end threads of a second tandem sub into a second end of the second perforating gun;

at least partially hand-tightening the second tandem sub onto the second perforating gun;

sliding the second end of the socket driver over the second end threads of the second tandem sub to engage the notched profile of the socket driver with slots along the shoulder of the second tandem sub; and while the first perforating gun remains rotationally fixed, applying rotation of the socket driver relative to the first perforating gun to make a tightened threaded connection between the first perforating gun, the first tandem sub, and the second perforating gun, simultaneously.

22. The method of claim 11, wherein:

the tandem sub at the first end of the gun barrel housing of the first perforating gun is a first tandem sub; and the method further comprises:

removing the socket driver from the second end threads of the tandem sub;

sliding the second end threads of the first tandem sub into a first end of the gun barrel housing of the second perforating gun, opposite the first perforating gun;

rotationally fixing the second perforating gun;

sliding the first end threads of a second tandem sub into a second end of the gun barrel housing of the second perforating gun;

at least partially hand-tightening the first end threads of the second tandem sub onto the second end of the second perforating gun;

sliding the second end of the socket driver over the second end threads of the second tandem sub to engage the notched profile of the socket driver with slots along a shoulder of the second tandem sub;

while the second perforating gun remains rotationally fixed, applying rotation of the socket driver relative to the first perforating gun to make a tightened threaded connection between the second tandem sub and the second perforating gun.

23. The method of claim 10, wherein:

the tandem sub is between 5 and 8 inches in length.

24. A method of connecting ends of perforating guns, comprising:

providing a tandem sub, the tandem sub having:

a first end defining first end threads, a second end defining second end threads, a bore extending from the first end to the second end, and an enlarged shoulder intermediate the first and second ends;

providing a first perforating gun, the first perforating gun comprising:

a gun barrel housing, a carrier tube residing within the gun barrel housing, and a plurality of shape charges residing along the carrier tube;

providing a second perforating gun, the second perforating gun also comprising:

a gun barrel housing having a first end and a second end, a carrier tube residing within the gun barrel housing, a plurality of shape charges residing along the carrier tube, and a shoulder formed around an outer diameter of the second end of the gun barrel housing of the second perforating gun, with the shoulder having slots forming a radial pattern;

providing a socket driver comprising:

an elongated tubular body defining a wall;

a first end, a second end opposite the first end and having a second inner diameter, and a radial notched profile configured to mate with the radial pattern of slots along the shoulder of the gun barrel housing of the second perforating gun;

sliding the first end threads of the tandem sub into a first end of the gun barrel housing of the first perforating gun;

sliding the second end threads of the tandem sub into a first end of the gun barrel housing of the second perforating gun;

engaging the notched profile of the socket driver with the slots along the shoulder of the second perforating gun;

rotationally fixing the first perforating gun;

applying rotation of the socket driver relative to the first perforating gun to make a threaded connection between the tandem sub and the first perforating gun.

25. The method of claim 24, wherein:

the radial notched profile of the socket driver comprises teeth equi-distantly spaced around the radial notched profile; and the shoulder of the second perforating gun comprises slots equi-distantly spaced around the shoulder and dimensioned to receive the teeth of the radial notched profile of the socket driver.

* * * * *